US006651558B2

(12) United States Patent
Benson

(10) Patent No.: US 6,651,558 B2
(45) Date of Patent: Nov. 25, 2003

(54) SYSTEM FOR INSERTING PAMPHLETS INTO A PRINTING PRESS

(76) Inventor: Harry A. Benson, 12647 Wornall Rd., Kansas City, MO (US) 64145

( * ) Notice: Subject to any disclaimer, the term of this patent is extended or adjusted under 35 U.S.C. 154(b) by 107 days.

(21) Appl. No.: 10/096,237

(22) Filed: Mar. 12, 2002

(65) Prior Publication Data

US 2003/0172823 A1 Sep. 18, 2003

(51) Int. Cl.[7] ..... B41F 13/24; B41F 5/16; B65H 29/34; B42B 2/00

(52) U.S. Cl. ..... 101/233; 101/137; 101/183; 271/189; 271/306; 270/52.2; 270/52.14; 270/52.19; 270/52.21

(58) Field of Search ..... 101/233, 137, 101/183, 352.1; 156/357, 248, 522, 64, 264, 459; 400/703; 271/189, 306; 270/52.2, 52.14, 52.19, 52.21

(56) References Cited

U.S. PATENT DOCUMENTS

| | | | | | |
|---|---|---|---|---|---|
| 4,560,432 | A | * | 12/1985 | Instance | 156/459 |
| 4,680,080 | A | | 7/1987 | Instance | 156/357 |
| 4,696,465 | A | * | 9/1987 | Willi | 271/237 |
| 4,838,985 | A | * | 6/1989 | Karagiannis | 156/522 |
| 4,882,004 | A | * | 11/1989 | Watson | 156/381 |
| 4,902,375 | A | * | 2/1990 | Holmes et al. | 156/516 |
| 4,933,043 | A | * | 6/1990 | Instance | 156/248 |
| 5,167,410 | A | * | 12/1992 | Greive et al. | 271/252 |
| 5,250,134 | A | * | 10/1993 | Thomas et al. | 156/264 |
| 5,277,741 | A | * | 1/1994 | Kramer | 156/353 |
| 5,415,716 | A | * | 5/1995 | Kendall | 156/256 |
| 5,599,422 | A | * | 2/1997 | Adams et al. | 156/510 |
| 5,718,098 | A | * | 2/1998 | Grosskopf et al. | 53/397 |
| 5,833,783 | A | * | 11/1998 | Choi et al. | 156/64 |
| 5,849,138 | A | * | 12/1998 | Olson | 156/522 |
| 5,882,470 | A | * | 3/1999 | Bohn et al. | 156/361 |
| 6,050,188 | A | * | 4/2000 | Bolza-Schunemann | 101/183 |
| 6,349,642 | B1 | * | 2/2002 | Olomski et al. | 101/183 |
| 6,382,098 | B2 | * | 5/2002 | Inoue et al. | 101/177 |
| 6,425,326 | B1 | * | 7/2002 | Dorenkamp et al. | 101/351.1 |
| 6,499,395 | B2 | * | 12/2002 | Aoyama et al. | 101/142 |
| 6,516,718 | B2 | * | 2/2003 | Kamoda et al. | 101/335 |
| 6,532,869 | B2 | * | 3/2003 | Aoyama et al. | 101/177 |

OTHER PUBLICATIONS

Video tape showing prior art On Serts Systems OS700 TM–2 (Exhibit A) No date available.

* cited by examiner

*Primary Examiner*—Andrew H. Hirshfeld
*Assistant Examiner*—Wasseem H. Hamdan
(74) *Attorney, Agent, or Firm*—Hovey Williams LLP

(57) ABSTRACT

An inserter (10) for synchronously feeding a preprinted portion ($X_1$) of a pamphlet into a printing press (P) to be adhered to a complemental portion of the pamphlet in substantial registration to form the completed pamphlet is disclosed. The inserter (10) broadly includes a feeder assembly (12), an aligner assembly (14), and a drive assembly (16). The feeder assembly (12) moves a plurality ($X_n$) of sequential preprinted portions ($X_1$, $X_2$ . . . $X_n$,) of the pamphlets along a substantially horizontal support surface (42) and then feeds them, one at a time, into the aligner assembly (14). The aligner assembly (14) includes aligner pins (246,248), that are universally spaced independent of the dimension of the preprinted portions ($X_n$), that aligns each of the pamphlet portions into the desired alignment so that the aligner assembly (14) can introduce them one at a time into the printing press (P) in sufficient registration to allow the formation of the completed pamphlets. The drive assembly (16) mechanically synchronizes the feeder and aligner assemblies (12,14) with the printing press (P) to enable the formation of the completed pamphlets.

16 Claims, 11 Drawing Sheets

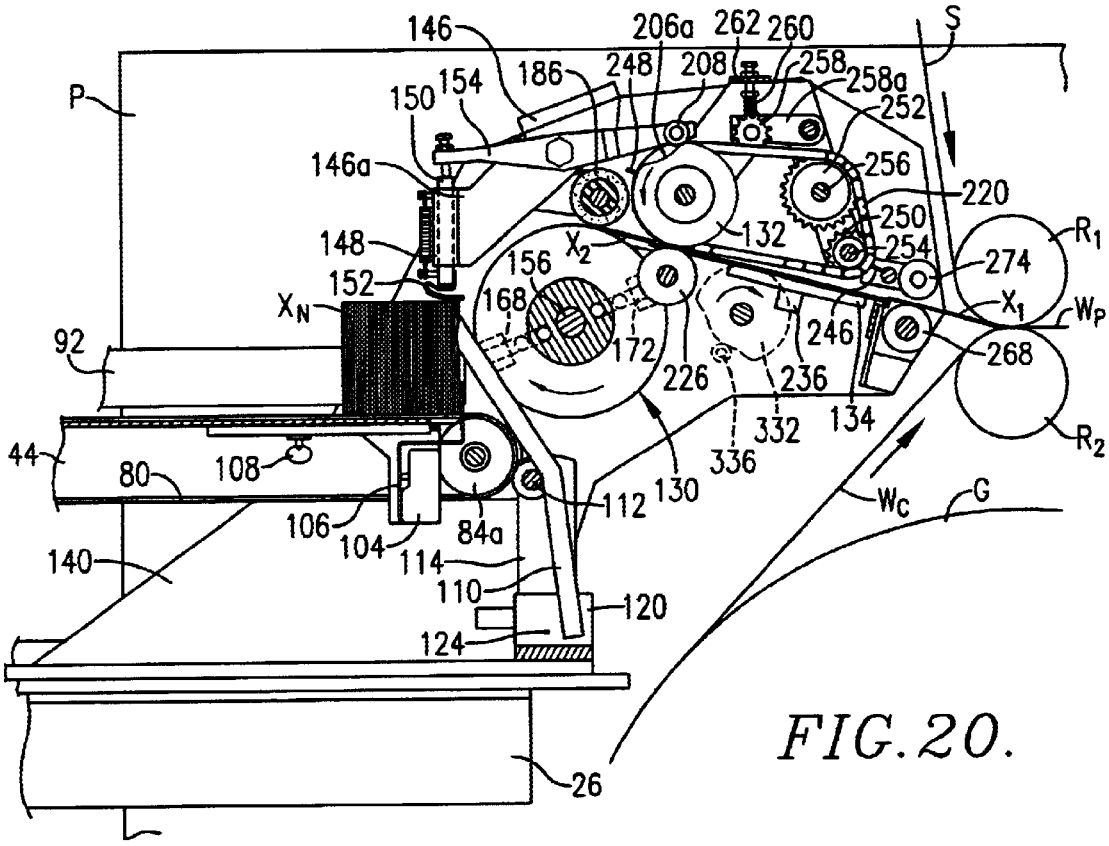
FIG. 20.
FIG. 21.
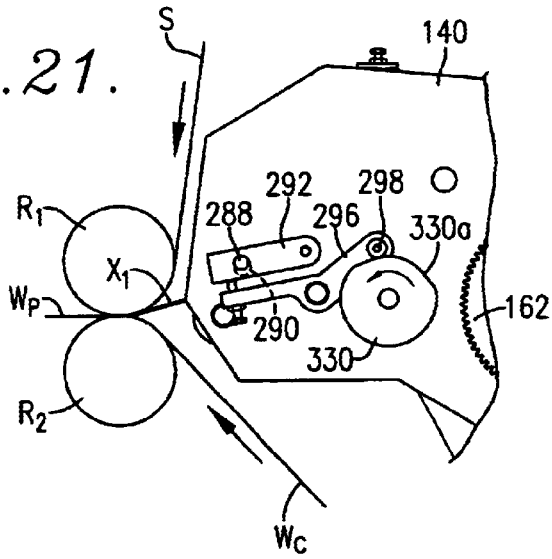

SYSTEM FOR INSERTING PAMPHLETS INTO A PRINTING PRESS

BACKGROUND OF THE INVENTION

1. Field of the Invention

The present invention relates generally to systems for producing labels. More specifically, the present invention concerns an improved system for inserting pamphlets into a printing press, wherein the improved system provides for non-gravity feed of the pamphlets, universal aligner pin spacing, and mechanical synchronization.

2. Discussion of Prior Art

Printed labels are applied to a wide variety of products and product packaging. These labels typically contain printed product information and are formed onto a web of backing material that enables the labels to be subsequently removed from the web and adhered to a respective container. One particular type of labels include pamphlets that typically have several printed pages that are folded accordion style and adhered to a corresponding container in a pocket or flap so that the user can access the pamphlet. For example, various governmental regulations require that certain types of products such as pesticides include informative or warning material on the product. Pamphlets are often utilized to carry this requisite product information.

These pamphlets are typically produced in three stages. In stage one, a portion of the pamphlet is printed (e.g., in a machine that prints a sheet and folds it into the accordion style portion of the pamphlet). In stage two, the preprinted portion of the pamphlet is inserted into a printing press where it is combined with a complemental portion of the pamphlet to form the completed pamphlet onto a web including a backing and a release material. In this stage, the printing press typically prints a back page of the pamphlet onto the release material, the preprinted portion is then placed onto the back page, and a sheet of adhesive material is compressed over the pamphlet and onto the web. The pamphlet-laden web is then fed through a dye cutting station associated with the printing press where the adhesive material and the release material are cut to size to form a string of web containing completed pamphlets. In stage three, the completed pamphlets are removed from the web and adhered to the product containers.

Systems for inserting the preprinted portions of pamphlets into a printing press utilizing an inserter during stage two discussed above are known in the art. It is important that the preprinted portions of the pamphlet be fed into the printing press at an appropriate rate (i.e., synchronized with the printing rate of the press) and in an appropriate alignment (i.e., in registration with the complemental portions of the pamphlet) to enable the press to form the completed pamphlet (i.e., a pamphlet where the preprinted portion and the complemental portion have substantial correspondence between the positioning of the respective printed pages of the pamphlet). Prior art inserters utilize a gravity feed to feed the preprinted portions of the pamphlet into a take-away cylinder (e.g., pneumatic driven, conveyor-type belt driven, etc.) that feeds the portions into an aligner pin assembly that aligns the portions and feeds them into the pinch rollers of a printing press. The gravity feed requires a plurality of the portions to be stacked up at least partially vertically so that gravity causes each portion to feed into the take-away cylinder. Prior art inserters utilize aligner pins that are dependent on the dimensions of the portion being fed. Therefore, when an operator desires to produce a different pamphlet having dimensions that vary from the previous pamphlet, the operator must change the aligner pins or their spacing. Prior art inserters also utilize electronically controlled devices (e.g., photooptic sensors, digital controllers, etc.) to synchronize the inserter with the corresponding printing press.

These prior art inserters are problematic and have several limitations. For example, the gravity feed feature is problematic as the preprinted pamphlet portions will often deform or overfeed. The gravity feeds undesirably require an operator to continuously stock, and align, pamphlet portions into the feeder to regulate the rate at which they feed into the take-away cylinder. In addition, prior art inserters require the operator(s) to change aligner pins, their spacing, in order to run a different sized pamphlet. Changing aligner pins, or their spacing, is time consuming and inefficient and therefore is undesirable. Furthermore, the electronically controlled devices utilized by prior art inserters are expensive, difficult to setup, and difficult to maintain, and thus are undesirable.

SUMMARY OF THE INVENTION

The present invention provides a system for inserting pamphlets that utilizes an improved inserter to insert the pamphlet portions into a printing press. The improved inserter does not suffer from the problems and limitations of the prior art inserters discussed above. The improved system provides for non-gravity feed of the pamphlet portions, universal aligner pin spacing that is independent of the pamphlet dimensions, and mechanical synchronization.

A first aspect of the present invention concerns an inserter for synchronously feeding a preprinted portion of a pamphlet into a printing press to be adhered to a complemental portion of the pamphlet in substantial registration to form the completed pamphlet, wherein the printing press includes a print cylinder that prints the complemental portion of the pamphlet. The inserter broadly includes a feeder assembly, an aligner assembly, and a drive assembly. The aligner assembly is operable to introduce the preprinted portions of the pamphlets into the printing press in sufficient alignment to allow the formation of the completed pamphlets. The drive assembly is operable to synchronize the feeder assembly and the aligner assembly with the printing press to enable the formation of the completed pamphlets. The feeder assembly is operable to feed the preprinted portion of the pamphlet into the aligner assembly and includes a power source and a substantially horizontal support surface. The power source is operable to move a plurality of the preprinted portions of the pamphlets along the support surface in a substantially horizontal direction into contact with the aligner assembly.

A second aspect of the present invention concerns an inserter for synchronously feeding a preprinted portion of a pamphlet into a printing press to be adhered to a complemental portion of the pamphlet in substantial registration to form the completed pamphlet, wherein the printing press includes a print cylinder that prints the complemental portion of the pamphlet and the preprinted portion of the pamphlet includes a leading edge and a trailing edge. The inserter broadly includes a feeder assembly, an aligner assembly, and a drive assembly operable to synchronize the feeder assembly and the aligner assembly with the printing press to enable the formation of the completed pamphlets. The feeder assembly is operable to feed the preprinted portion of the pamphlet into the aligner assembly. The aligner assembly is operable to introduce the preprinted portions of the pamphlets into the printing press in sufficient alignment to allow the formation of the completed pamphlets. The aligner assembly includes a pneumatic take-away cylinder and a pair of spaced aligner pins. The take-away cylinder is operable to transfer the preprinted portion of the pamphlet from the feeder assembly to at least one of the aligner pins. Each of the aligner pins is operable to position the preprinted portion of the pamphlet into the sufficient alignment. The spacing between the aligner pins is independent of the dimensions of the preprinted portion of the pamphlet.

A third aspect of the present invention concerns an inserter for synchronously feeding a preprinted portion of a pamphlet into a printing press to be adhered to a complemental portion of the pamphlet in substantial registration to form the completed pamphlet, wherein the printing press includes a bull gear linked to a print cylinder by a print gear that drives the print cylinder at a print rate to print the complemental portion of the pamphlet. The inserter broadly includes a feeder assembly, an aligner assembly, and a drive assembly. The aligner assembly is operable to introduce the preprinted portions of the pamphlets into the printing press in sufficient alignment to allow the formation of the completed pamphlets. The drive assembly is operable to mechanically synchronize the feeder assembly and the aligner assembly with the printing press to enable the formation of the completed pamphlets. The feeder assembly is operable to feed the preprinted portion of the pamphlet into the aligner assembly. The aligner assembly includes a pneumatic take-away cylinder and a pair of spaced aligner pins. The take-away cylinder is operable to transfer the preprinted portion of the pamphlet from the feeder assembly to at least one of the aligner pins. Each of the aligner pins is operable to position the preprinted portion of the pamphlet into the sufficient alignment. The drive assembly includes a drive gear operable to be in mechanical communication with the bull gear so that when they are in mechanical communication the drive gear is synchronized with the print rate. The drive assembly further includes a timing chain mechanically linking the drive gear with the take-away cylinder and the aligner pins so that when the drive gear is in mechanical communication with the bull gear the take-away cylinder and the aligner pins are synchronized with the print rate.

A fourth aspect of the present invention concerns an inserter for synchronously feeding a preprinted portion of a pamphlet into a printing press to be adhered to a complemental portion of the pamphlet in substantial registration to form the completed pamphlet, wherein the printing press includes a bull gear that drives a print cylinder at a print rate to print the complemental portion of the pamphlet. The inserter broadly includes a feeder assembly, an aligner assembly, and a drive assembly. The feeder assembly is operable to feed the preprinted portion of the pamphlet into the aligner assembly and includes a power source and a substantially horizontal support surface. The power source is operable to move a plurality of the preprinted portions of the pamphlets along the support surface in a substantially horizontal direction into contact with the aligner assembly. The aligner assembly is operable to introduce the preprinted portions of the pamphlets into the printing press in sufficient alignment to allow the formation of the completed pamphlets. The aligner assembly includes a pneumatic take-away cylinder and a pair of spaced aligner pins. The take-away cylinder is operable to transfer the preprinted portion of the pamphlet from the feeder assembly to at least one of the aligner pins. Each of the aligner pins is operable to position the preprinted portion of the pamphlet into the sufficient alignment. The spacing between the aligner pins is independent of the dimensions of the preprinted portion of the pamphlet. The drive assembly is operable to mechanically synchronize the feeder assembly and the aligner assembly with the printing press to enable the formation of the completed pamphlets. The drive assembly includes a drive gear operable to be in mechanical communication with the bull gear so that when they are in mechanical communication the drive gear is synchronized with the print rate. The drive assembly further includes a timing chain mechanically linking the drive gear with the take-away cylinder and the aligner pins so that when the drive gear is in mechanical communication with the bull gear the take-away cylinder and the aligner pins are synchronized with the print rate.

A fifth aspect of the present invention concerns a method of synchronously inserting preprinted portions of pamphlets into a printing press to be adhered to complemental portions of the pamphlets in substantial registration to form completed pamphlets. The method broadly includes the steps of (a) loading a plurality of the preprinted portions of the pamphlets onto a substantially horizontal support surface; (b) moving the plurality of the preprinted portions of the pamphlets along the support surface in a substantially horizontal direction into contact with a cylinder; (c) passing each of the preprinted portions of the pamphlets past the cylinder; (d) positioning each of the preprinted portions of the pamphlets into the sufficient alignment using one of a pair of spaced aligner pins; and (e) synchronously introducing the preprinted portions of the pamphlets into the printing press to enable the formation of the completed pamphlets.

A sixth aspect of the present invention concerns an inserter for synchronously feeding a preprinted portion of a pamphlet into a Rotary Printing and Die Cutting Equipment manufactured by Mark Andy Inc. of St. Louis, Mo. to be adhered to a complemental portion of the pamphlet in substantial registration to form the completed pamphlet. The inserter broadly includes a feeder assembly, an aligner assembly, and a drive assembly. The feeder assembly is operable to feed the preprinted portion of the pamphlet into the aligner assembly and includes a power source and a substantially horizontal support surface. The aligner assembly is operable to introduce the preprinted portions of the pamphlets into the Rotary Printing and Die Cutting Equipment in sufficient alignment to allow the formation of the completed pamphlets and includes a pair of spaced aligner pins. The drive assembly is operable to mechanically synchronize the feeder assembly and the aligner assembly with the Rotary Printing and Die Cutting Equipment to enable the formation of the completed pamphlets and includes a drive gear and a timing chain.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

FIG. 20 is a view of the inserter similar to the views of FIGS. 14–19 with the pamphlet portions further advancing through the cycle particularly illustrating the forward-most pamphlet portion being inserted in registration into the pinch rollers of the printing press with the nip rubber roller in the clearance position and the next pamphlet portion engaging the vacuum plate; and FIG. 21 is an enlarged fragmentary elevational view of the drive side of the inserter and shown with the forward-most pamphlet portion in the same cycle position as illustrated in FIG. 20 shown in combination with the printing press (pinch rollers and webbing shown schematically) particularly illustrating the clearance position of the nip roller.

DETAILED DESCRIPTION OF THE PREFERRED EMBODIMENTS

Figure 1:
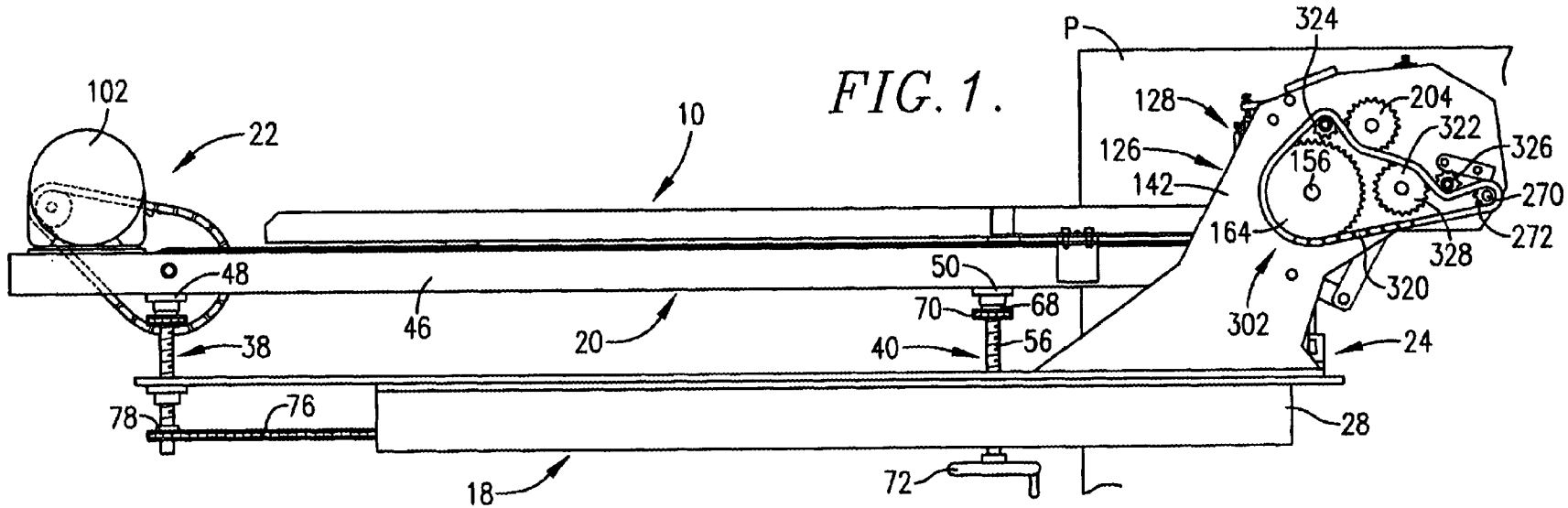
FIG. 1 is a side elevational view of an inserter constructed in accordance with a preferred embodiment of the present invention and shown in combination with a printing press (fragmentary view)
Figure 10:
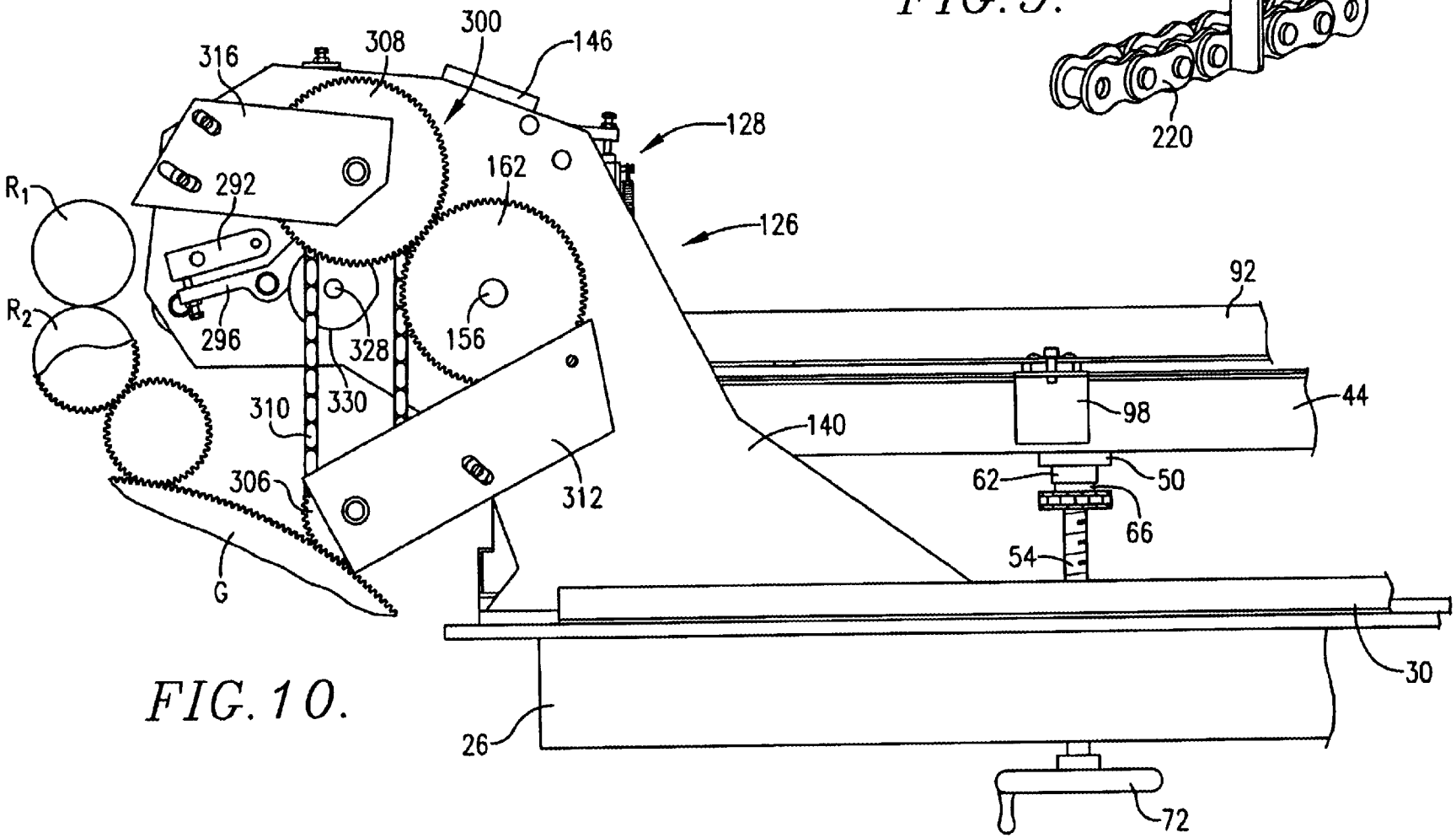
FIG. 10 is an enlarged fragmentary side elevational view of the drive side of the inserter illustrating the transmission of the drive assembly and shown in combination with the printing press (fragmentary view with the rollers shown schematically)

FIG. 1 illustrates an inserter 10 constructed in accordance with a preferred embodiment of the present invention and configured for synchronously feeding a preprinted portion $X_1$ (see e.g., FIG. 14) of a pamphlet into a printing press P to be adhered to a complemental portion (not shown) of the pamphlet in substantial registration to form the completed pamphlet (not shown). The printing press P includes a bull gear G (see e.g., FIG. 10) that drives a print cylinder (not shown) at a print rate to print the complemental portion of the pamphlet. The print cylinder prints the complemental portion (e.g., the back page of the pamphlet) on a webbing $W_c$ (see e.g., FIG. 14) comprising a plurality of complemental portions, a release material, and a backing material. The preprinted portion $X_1$ is then inserted into the press P between the webbing $W_c$ and a sheet of adhesive material S (see, e.g., FIG. 14). The press P includes pinch rollers $R_1$ and $R_2$ that form the adhesive material S, the pamphlet portion X1 and the webbing $W_c$ having the printed complemental portion, into a pamphlet-laden web $W_p$ (see, e.g., FIG. 14). The web $W_p$ subsequently passes through a die cutting station (not shown) of the press P where it is cut to size to form a string of webbing (not shown) containing completed pamphlets.

As described in detail below, a completed pamphlet can only be adequately formed if the pamphlet portion $X_1$ is fed into the press P at substantial registration with the complemental portion and in synchrony with the webbing $W_c$. The inserter 10 is particularly well suited for use with a Rotary Printing and Die Cutting Equipment manufactured by Mark Andy Inc. of St. Louis, Mo. (e.g., available as model number 91 4N10Y). However, the inserter of the present invention could be adapted to be used with virtually any gear-driven rotary press that is capable of producing pamphlet-type labels. Additionally, although the inserter 10 is also well suited for feeding pamphlets, the principles of the present invention could be utilized for feeding other types of labels into a printing press (e.g., book-type labels, any free standing insert, etc.).

Figure 2:
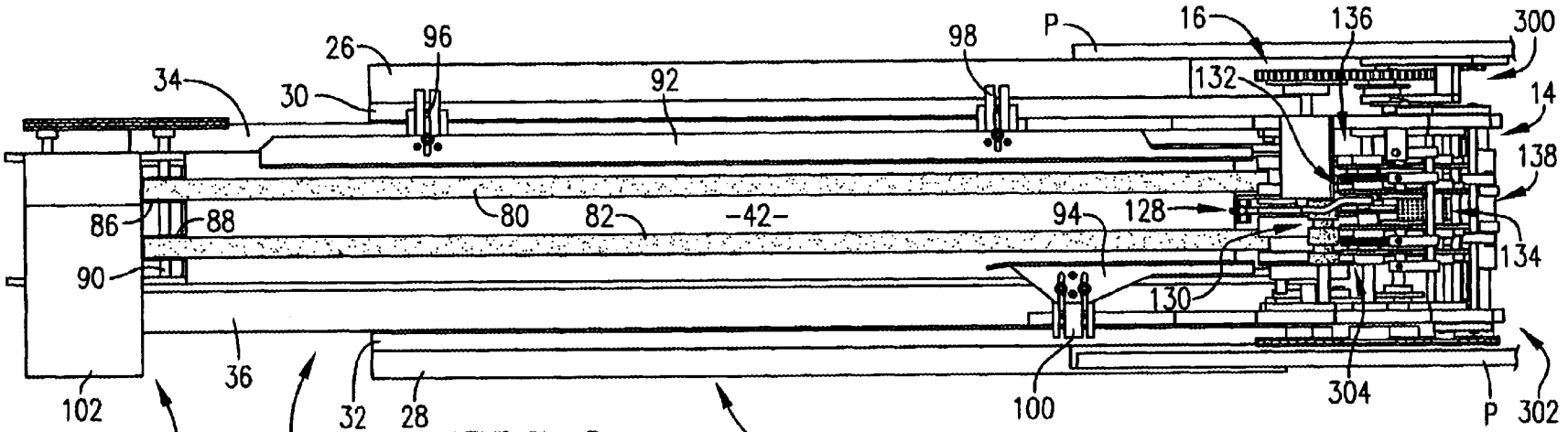
FIG. 2 is a plan view of the inserter shown in combination with the printing press (fragmentary view)

The inserter 10 broadly includes a feeder assembly 12, an aligner assembly 14, and a drive assembly 16 (see FIG. 2). The feeder assembly 12 feeds a plurality $X_n$ of sequential preprinted portions $X_1$, $X_2$ . . . $X_n$ of the pamphlets, one at a time, into the aligner assembly 14. The aligner assembly 14 receives the preprinted portions $X_n$, aligns each of them into the desired alignment, and introduces them one at a time into the printing press P in sufficient registration to allow the formation of the completed pamphlets. The drive assembly 16 mechanically synchronizes the feeder and aligner assemblies 12,14 with the printing press P to enable the formation of the completed pamphlets.

Figure 5:
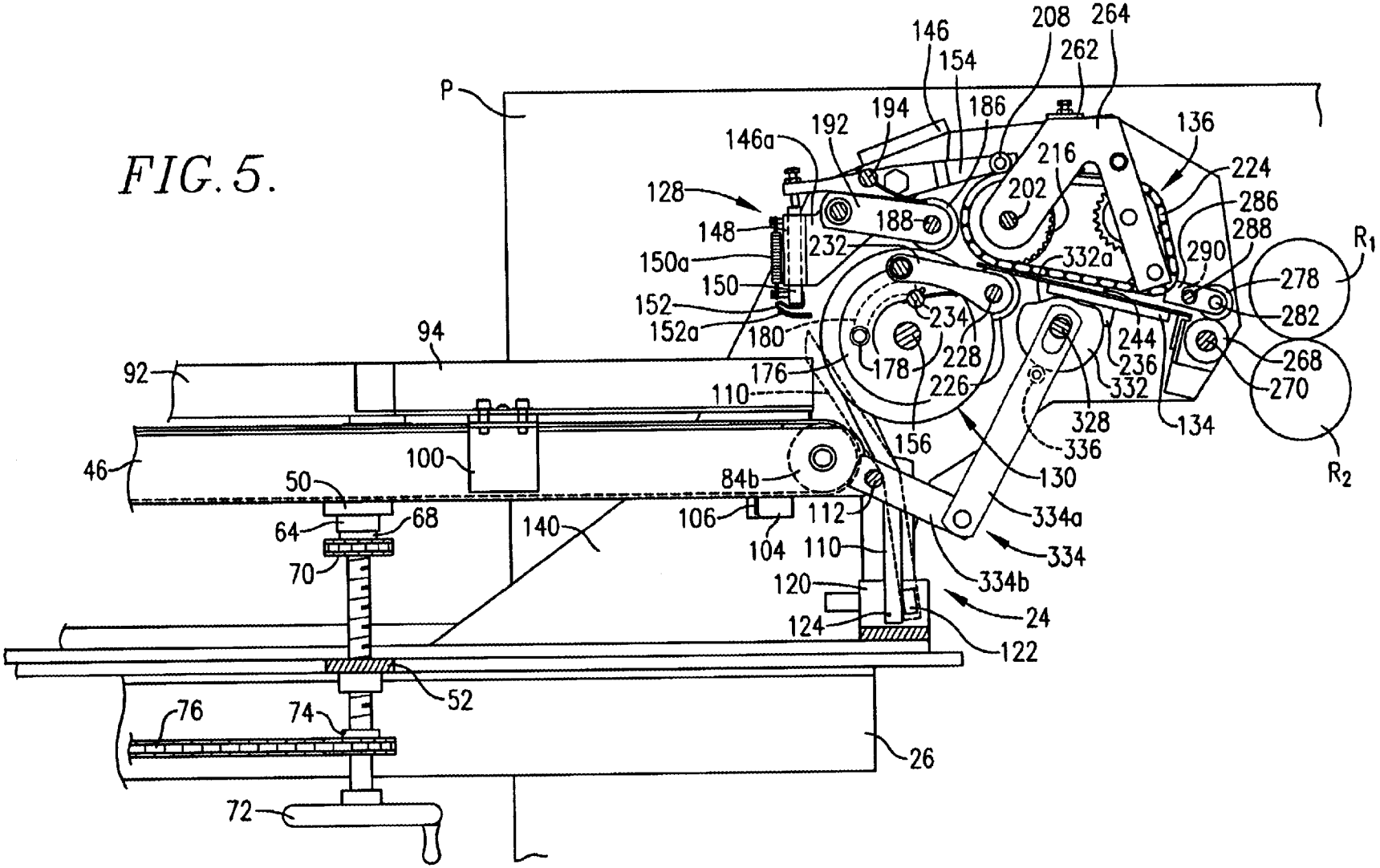
FIG. 5 is an enlarged fragmentary sectional view of the inserter taken substantially along line 5—5 of FIG. 4 and shown in combination with the printing press (fragmentary view with the pinch rollers shown schematically)

As shown in FIGS. 1 and 5, the feeder assembly 12 includes a base 18, a pamphlet support table 20, a feeder power source 22, and a sucker 24. In more detail, the base 18 includes a pair of L shaped supports 26 and 28 that are fixed at one end to a respective wall of the printing press (see FIG. 6), and extend horizontally therefrom. The supports 26,28 provide the primary support for the inserter 10 on the press P. However, in some applications, it may be desirable to further support the ends of the base supports distal to the press with additional structure such as base legs (not shown). For purposes that will subsequently be discussed, the base 18 is configured to slidably receive the aligner assembly 14. In this regard, the base 18 includes a pair of tracks 30 and 32, each being fixed to the top of the corresponding support 26 and 28, respectively (see FIGS. 2 and 6). As will be described in detail below, the aligner assembly 14 includes a pair of horizontal bars 34 and 36 that are slidably received within the tracks 30,32.

The pamphlet support table 20 is adjustably supported on the horizontal bars 34,36 by a pair of vertical adjustment assemblies 38 and 40 (see FIG. 1). Therefore, the table 20 is horizontally fixed relative to the aligner assembly 14 and slidably supported on the tracks 30,32. The table 20 includes a horizontal support surface 42 supported by a pair of vertical members 44 and 46 (see FIGS. 2 and 7). The vertical members 44,46 are joined by a pair of lateral members 48 and 50 that are supported on the corresponding vertical adjustment assemblies 38,40, respectively (see FIG. 1). The horizontal support surface 42 is substantially horizontal so that the plurality of preprinted pamphlet portions $X_n$ require power assist to feed into the aligner assembly 14 as opposed to not substantially horizontal wherein the portions $X_n$ could feed into the assembly 14 by gravity alone.

Figure 7:
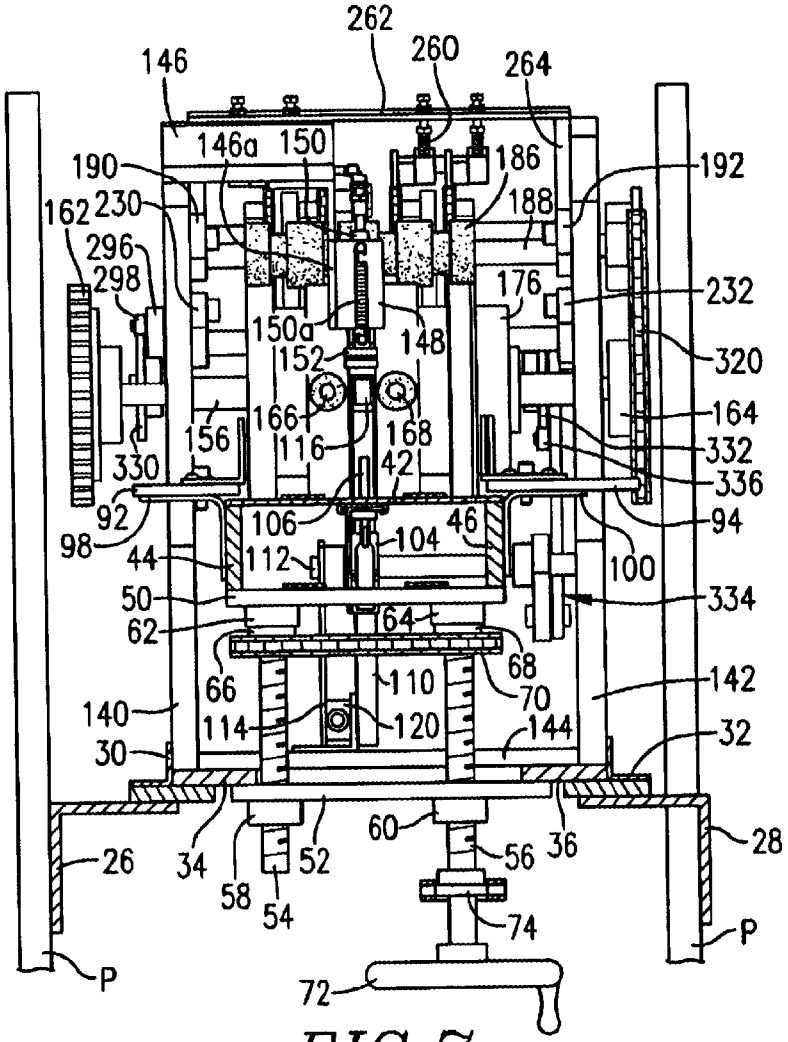
FIG. 7 is an enlarged vertical sectional view of the inserter illustrating the pamphlet support table and shown in combination with the printing press (fragmentary view)

As indicated above the table 20 is vertically adjustable relative to the bars 34,36, and thus the aligner assembly 14, by the adjustment assemblies 38,40. This vertical adjustment allows the illustrated inserter 10 to insert pamphlet portions into the press P ranging in width (relative to the height and thickness of the pamphlet) from about two-and-one-eighth inches to about eight inches. In this regard, the adjustment assemblies 38 and 40 are virtually identically configured and therefore only the assembly 40 will be described in detail with the understanding that the assembly 38 is similarly constructed. As shown in FIG. 7, the vertical adjustment assembly 40 includes a transverse member 52 fixed between the bars 34 and 36 and having a pair of shaft-receiving apertures (not shown). A pair of threaded shafts 54 and 56 extend through the apertures in the member 52 and are each threadably received in a corresponding one of a pair of nuts 58 and 60 that are fixed to the bottom of the transverse member 52. The upper end of each of the shafts 54,56 is journaled into a corresponding bushing 62, 64, respectively, that is fixed to the bottom of the lateral member 50. Fixed to each of the shafts 54,56 adjacent its upper end is a corresponding one of a pair of sprockets 66 and 68 that are entrained by an endless chain 70. In this manner, both of the shafts 54,56 rotate in unison when either of the shafts 54,56 is rotated. Fixed to the lower end of the shaft 56 is wheel 72 for rotating the shaft 56. A second sprocket 74 is fixed to the shaft 56 adjacent the wheel 72 and is entrained by an endless chain 76. The chain 76 further entrains a similar sprocket 78 on the adjustment assembly 38 (see FIG. 1). In this manner, both of the assemblies 38,40 rotate in unison when the assembly 40 is rotated by the wheel 72. It is within the ambit of the present invention to utilize various alternative configurations for the height adjustment as long as the support surface 42 is substantially horizontal. For example, the adjustment assemblies could be driven by a motorized power source.

Figure 4:
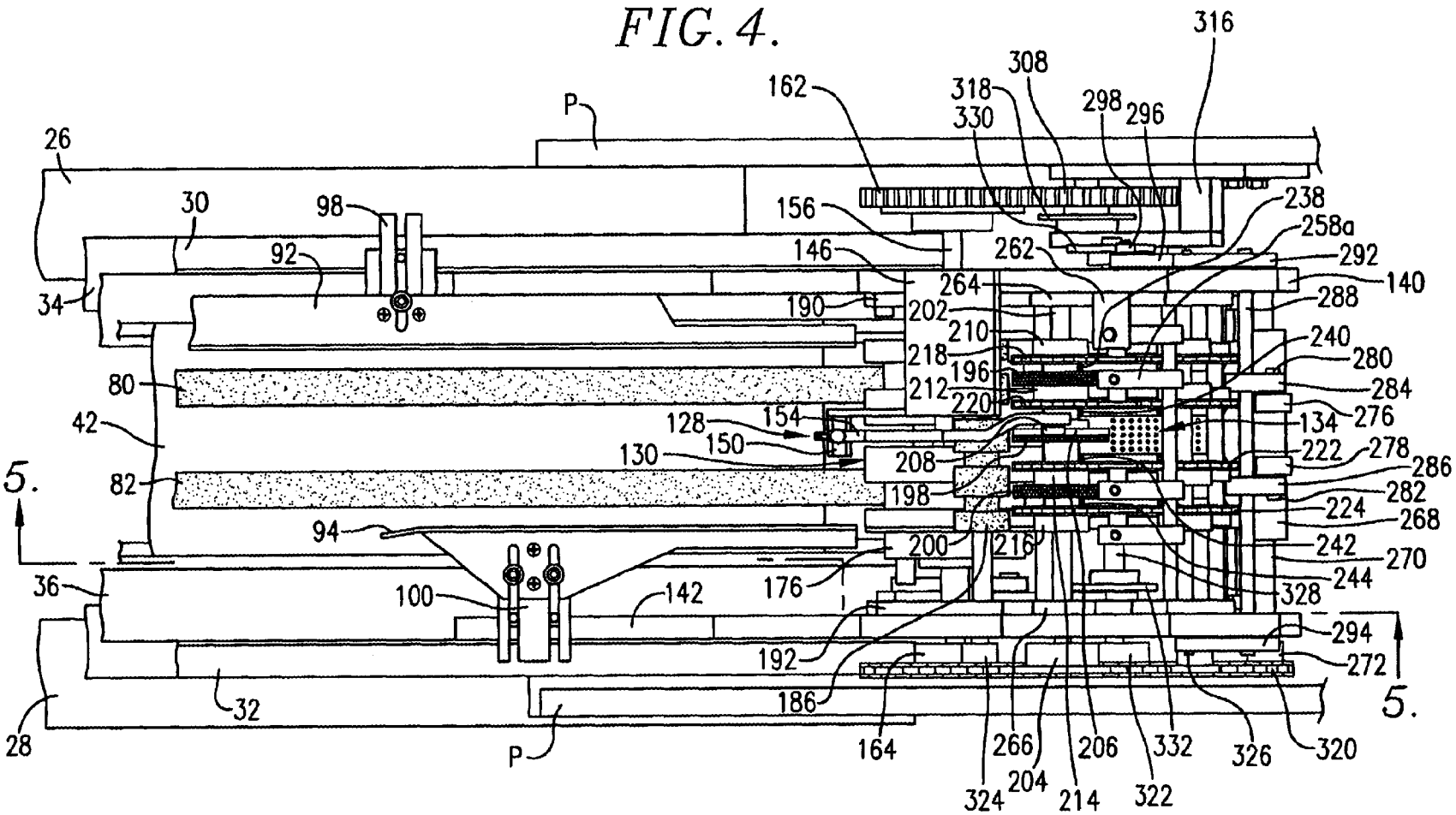
FIG. 4 is an enlarged fragmentary top view of the inserter shown in combination with the printing press (fragmentary view)
Figure 14:
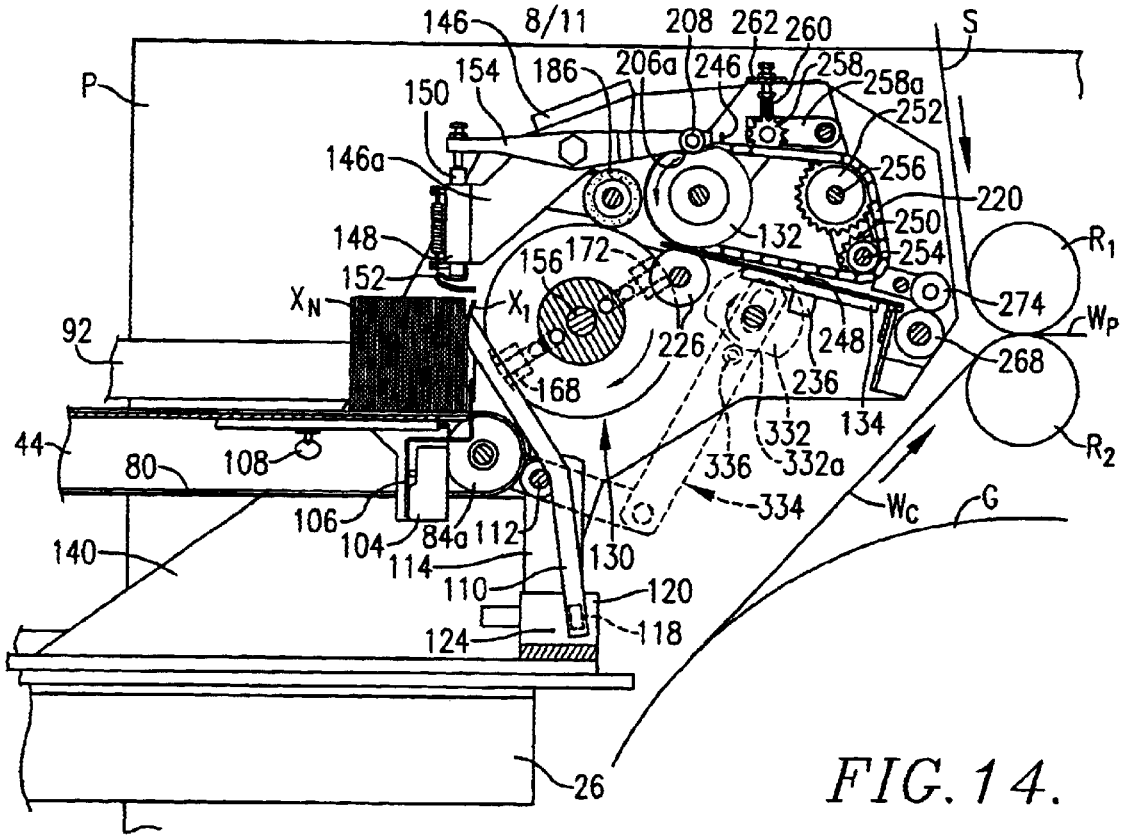
FIG. 14 is an enlarged fragmentary side elevational view of the inserter with parts of the housing broken away and shown with a plurality of preprinted portions of pamphlets loaded in the feeder assembly with the forward most pamphlet portion initiating a cycle through the inserter and shown in combination with the printing press (fragmentary view with rollers and webbing shown schematically)

Turning to FIGS. 2 and 4, a pair of endless conveyor belts 80 and 82 encircle the horizontal support surface 42 of the table 20 for advancing the preprinted pamphlet portions $X_n$ along the surface 42 (see also FIG. 14). At the end of the belts 80,82 proximate to the aligner assembly 14, each of the belts 80,82 entrain a respective one of a pair of free-wheeling sheaves 84*a* and 84*b* (see FIGS. 5 and 14) that are each rotatably mounted on a corresponding vertical member 44,46. At the distal ends of the belts 80,82, each entrains a respective one of a pair of drive sheaves 86,88 that are fixed to a driven shaft 90 (see FIG. 2). As the conveyor belts 80,82 move the pamphlet portions $X_n$ along the support surface 42, the portions $X_n$ engage guide rails 92 and 94 that facilitate guiding the portions $X_n$ along the surface 42 (see FIGS. 2 and 4). The guide rail 92 extends along, and adjacent to, a substantial portion of the belt 80. The rail 92 is mounted on the vertical member 44 by a pair of bracket assemblies 96 and 98 (see FIGS. 2 and 7). The guide rail 94 is relatively shorter than the rail 92 and is flared at the end distal to the aligner assembly 14 to facilitate aligning the pamphlet portions $X_n$ against the guide rail 92. The rail 94 is mounted on the vertical member 46 by a bracket assembly 100 (see FIG. 7). Each of the illustrated bracket assemblies 96,98,100 are laterally adjustable to accommodate pamphlet portions ranging in height (relative to the width and thickness of the pamphlet) from about two-and-one-eighth inches to about eight inches.

The conveyor belts 80,82 that advance the pamphlet portions $X_n$ are driven by the power source 22. In particular, the power source 22 includes a motor 102 controlled by a switch 104 (see FIGS. 2 and 7). The motor 102 includes an output shaft 106 that is fixed at its distal end to a drive sprocket 108. An endless chain entrains the drive sprocket 108 and extends therefrom to entrain a driven sprocket 110 that is fixed to the driven shaft 90. For purposes that will subsequently be described, the motor 102 is preferably configured to provide for frequent and continuous speed reduction in a range that includes zero output, generally constant torque throughout the speed range, and having the capability of holding any speed in the range. One suitable motor is an electric motor having a Zero-Max® Drive available as Model No. JK3-REV-250-400 from Zero-Max, Inc. of Plymouth, Minn.

Figure 15:
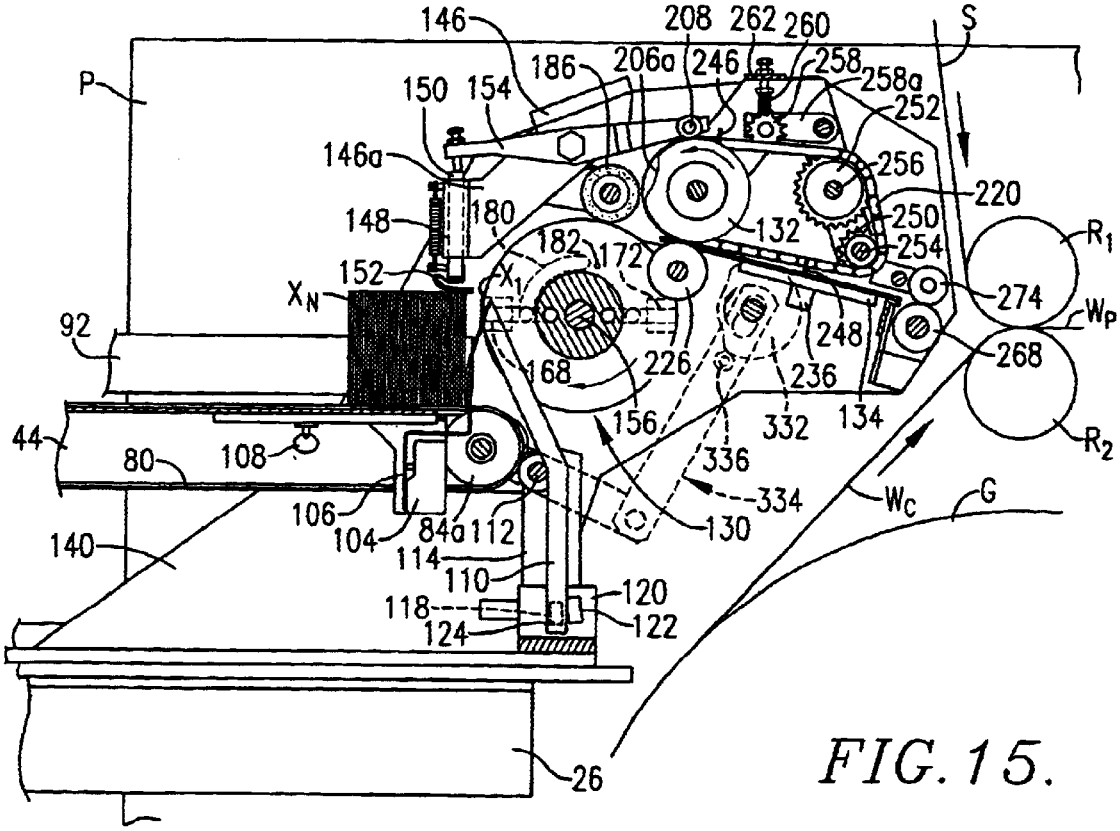
FIG. 15 is a view of the inserter similar to the view of FIG. 14 with the forward-most pamphlet portion advancing through the cycle particularly illustrating the sucker transferring the portion to the take-away cylinder.

The motor 102 drives the belts 80,82 to advance the pamphlet portions $X_n$ along the support surface 42 until the forward-most sequential pamphlet portion (e.g., portion $X_1$ in FIGS. 14 and 15) is fully engaged by the sucker 24 as shown in FIG. 15 (as will subsequently be described). When the forward-most pamphlet has reached this position, the switch 104 is triggered thereby causing the motor 102 to switch to zero output wherein the pamphlet portions $X_n$ are temporarily paused from advancing along the surface 42. The illustrated switch 104 includes a trigger element 106 (see FIG. 7) that extends above the surface 42 and is positioned to engage the forward-most pamphlet portion (e.g., portion $X_1$ in FIGS. 14 and 15) when it reaches the desired position shown in FIG. 15. Once the sucker 24 removes the forward-most pamphlet portion from the support surface 42, the element 106 of the switch 104 is no longer engaged therewith and thus causes the motor 102 to resume moving the belts 80,82 to advance the pamphlets $X_n$ until the next forward-most pamphlet portion reaches the desired position illustrated in FIG. 15. In the illustrated switch 104, the position of the trigger element 106 relative to the end of the support surface 42 is adjustable by a thumbscrew 108. For example, if the stiffness of the pamphlets varies (e.g., the pamphlets bend over to one side or the other), the positioning of the trigger element 106 can be adjusted to compensate for the variance. The switch 104 is preferably configured to sense, and be responsive to, small changes in control input, for example, to accommodate pamphlet portions having a thickness (relative to the height and width of the pamphlet) as small as less than about one-eighth of an inch. One suitable switch is a Micro Switch® available as Model No. BZ2RW263-A2 from Honeywell Inc. of Minneapolis, Minn.

Figure 6:
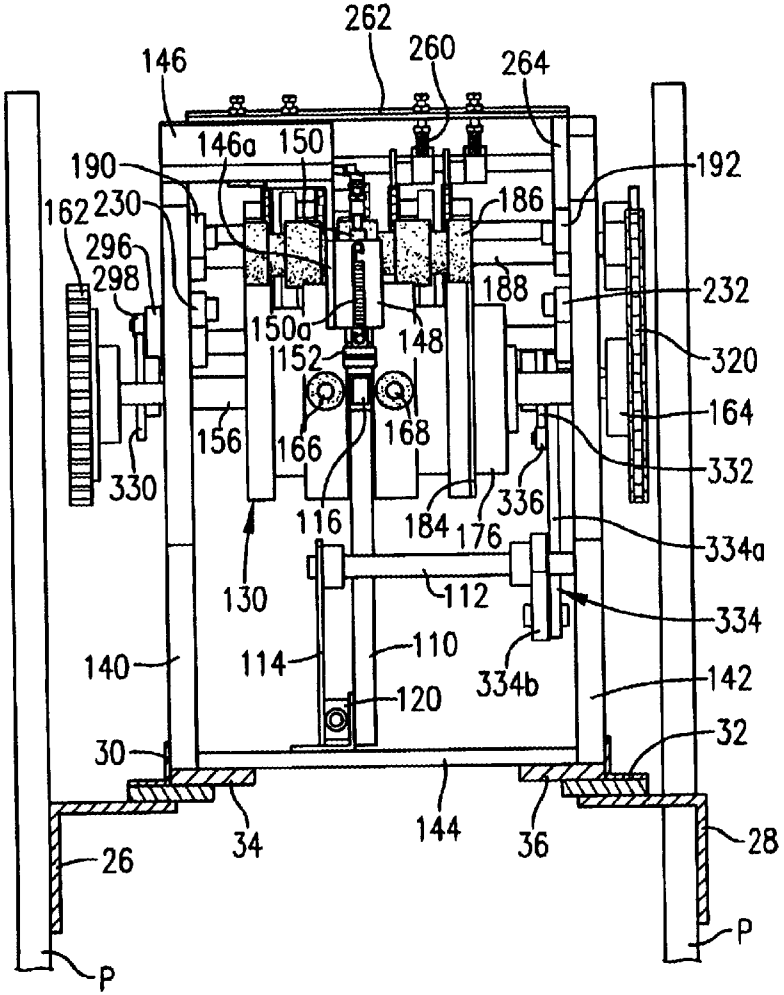
FIG. 6 is an enlarged vertical sectional view of the inserter with the pamphlet support table broken away illustrating the take-away cylinder and the sucker and shown in combination with the printing press (fragmentary view)

The sucker 24 transfers the forward-most pamphlet portion (i.e., portion $X_1$ in FIGS. 14 and 15) from the horizontal support surface 42 to the aligner assembly 14. As will be subsequently described in detail, the sucker 24 introduces the preprinted pamphlet portions $X_n$ into the aligner assembly 14 at the desired rate as controlled by the drive assembly 16. As shown in FIGS. 5 and 6, the sucker 24 includes a sucker rod 110 that is pivotally attached to the aligner assembly 14. In particular, the rod 110 is fixed to a sucker shaft 112 that is rotatably supported on the housing crossbar (discussed below) of the aligner assembly 14 at one end by a bracket assembly 114 and rotatably supported (e.g., journaled, bushinged, etc.) at its opposite end in a housing wall (discussed below) of the aligner assembly 14. As will be described in detail below, the drive assembly 16 causes the shaft 112 to partially rotate. As the shaft 112 rotates, the rod 110 that is fixed to the shaft 112 is caused to pivot. Specifically, the rod 110 pivots between an engagement position as shown in FIG. 14 and a transfer position as shown in FIG. 15. When the rod 110 is in the engagement position, its upper end is generally coplanar with the triggering element 106 of the switch 104 so as to contact the plurality of pamphlet portions $X_n$. When the rod 110 is in the transfer position, its upper end is horizontally downstream of the element 106 so as to be removed from the plurality of pamphlet portions $X_n$.

The sucker rod 110 includes a upper vacuum port 116 at its upper end in vacuum communication with a lower vacuum port 118 at its lower end (see FIGS. 6 and 15). Adjacent the lower port 118 is a vacuum manifold 120 fixed relative to the rod 110 on the housing crossbar of the aligner assembly 14. The manifold 120 is in vacuum communication with a vacuum source (not shown). The manifold 120 includes a gasketed manifold port 122 that has a shape that is complemental to the shape of the lower port 118 of the rod 110 (see FIGS. 5 and 15). The manifold further includes a relief aperture 124 in air communication with the atmosphere. The manifold 120 and the rod 110 are configured so that when the rod 110 is in the engagement position (shown in phantom in FIG. 5), the lower port 118 of the rod 110 and the manifold port 122 are in a generally sealed, communicating relationship (see FIG. 5). The manifold 120 and the rod 110 are further configured so that when the rod 110 is in the transfer position (shown in solid in FIG. 5), the lower port 118 of the rod 110 and the relief aperture 124 of the manifold 120 are in a communicating relationship. In this manner, when the rod 110 is in the engagement position, vacuum pressure is supplied through the upper port 116 to adhere the forward-most pamphlet portion (portion $X_1$ in FIG. 14) to the upper end of the sucker rod 110 as shown in FIG. 14. For purposes that will be subsequently described, the upper end surface of the rod 110 that contacts the pamphlet portion is preferably arcuate shaped to facilitate pulling the upper end of the forward-most pamphlet portion away from the remaining plurality of pamphlet portions $X_n$ (see FIG. 14). When the rod 110 is in the transfer position, vacuum pressure through the upper port 116 is broken by the relief aperture 124 so that the pamphlet portion (e.g., portion $X_n$ in FIG. 15) no longer adheres to the upper end of the sucker rod 110 as shown in FIG. 15. When the pamphlet portion is released by the sucker rod 110, as will be described in detail below, it is simultaneously picked up by the aligner assembly 14.

As indicated above, the aligner assembly 14 receives the preprinted portions $X_n$ from the feeder assembly 12, aligns each of them into the desired registration, and introduces them one at a time into the printing press P in sufficient alignment to allow the formation of the completed pamphlets. As shown in FIGS. 1–2 and 4–5, the aligner assembly 14 includes a housing 126, a holdback foot 128, a takeaway cylinder 130, an aligner pin assembly 136 including a knurled roller 132 and a vacuum plate 134, and a nip roller 138.

In more detail, the housing 126 supports all of the components of the aligner assembly 14 on the base 18 of the feeder assembly 12 and includes the horizontal bars 34,36 slidably received on the tracks 30,32 of the base 18 as detailed above. Additionally, the housing 126 includes a pair of vertical sidewalls 140 and 142, and a crossbar 144 extending between the walls 140,142 (see FIG. 6). As previously described, the bracket assemby 114 and the vacuum manifold 120 of the sucker 24 are fixed to the crossbar 144 and the end of the sucker shaft 112 is rotatably supported in the sidewall 142. The walls 140,142 and the crossbar 144 are supported on the bars 34,36 so that the entire housing 126 is slidably adjustable relative to the base 18 and thus relative to the press P. In this regard, and as will be further detailed below, for pamphlet portions having varying widths, the aligner assembly 14 is slid closer to, or further from, the press P to set a desired distance between the nip roller 138 and the pinch rollers $R_1$, $R_2$ corresponding to the width of the pamphlet portions. As certain pamphlet widths may be more prevalent than others, the inserter 10 includes structure for setting preselected positions of the aligner assembly 14 relative to the base 18 that correspond with the more prevalent pamphlet widths. For example, the bars 34,36 include bolt-receiving apertures (not shown) and the tracks 30,32 and/or the L shaped supports 26,28 include a plurality of similar, but threaded, apertures (not shown) that correspond to the preselected positions and are configured for receiving bolts (not shown) to secure the aligner assembly 14 in one of the preselected positions.

As previously indicated, when a pamphlet portion $X_{1-n}$ is released by the sucker rod 110, it is simultaneously picked up by the aligner assembly 14. In particular, the holdback foot 128 and the takeaway cylinder 130 cooperate with the sucker 24 to transfer the pamphlet portion $X_{1-n}$ to the knurled roller 132. As shown in FIGS. 14 and 15, once the forward-most pamphlet portion $X_1$ is engaged by the sucker rod 110, the holdback foot 128 prevents the remaining pamphlet portions $X_n$ from being drawn into the takeaway cylinder 130 or interfering with the transfer of the forward-most pamphlet portion. In detail, the holdback foot 128 is supported on the housing sidewall 140 by a bracket 146 having an arm portion **146*a* (see FIGS. 4 and 5). Fixed to the bracket arm portion 146*a* is a piston case 148 that slidably receives a piston 150. Fixed to the bottom of the piston 150** is resilient foot element 152 carrying a jacket 152*a* on its bottom-most surface. The jacket 152*a* is preferably formed of foam rubber (e.g., one-eighth inch thick foam rubber) that sufficiently grips the plurality of pamphlet portions $X_n$ to hold them back from the sucker 24 and the takeaway cylinder 130 (see FIG. 15). The top of the piston 150 is coupled to one end of a pivot arm 154. The piston 150 is biased against the pivot arm 154 by a spring 150*a*. The pivot arm 154 is pivotally supported at its middle on the bracket 146 (see FIGS. 4 and 5). As will subsequently be described, the opposite end of the pivot arm 154 is linked to a component of the drive assembly 16.

The pivot arm 154 pivots causing the piston 150 to slide relative to the case 148 thereby moving the foot element 152 between a clearing position as shown in FIG. 14 and a holdback position as shown in FIG. 15. When the holdback foot 128 is in the clearing position, the element 152 does not contact the plurality of pamphlet portions $X_n$ thus allowing the sucker rod 110 (having the arcuate shaped face) to pull the upper end of the forward-most pamphlet portion away from the remaining plurality of pamphlet portions $X_n$ (see FIG. 14). The upper end of the forward-most pamphlet portion adheres to the arcuate shaped face of the sucker rod 110 thereby providing sufficient clearance to allow the holdback foot 128 to engage the plurality of pamphlet portions $X_n$ without holding back the forward-most pamphlet portion (see FIGS. 14 and 15). When the holdback foot 128 is in the holdback position, the element 152, particularly the jacket 152*a* thereof, engages the plurality of pamphlet portions Xn to prevent them from being drawn into the takeaway cylinder 130 or interfering with the transfer of the forward-most pamphlet portion (see FIG. 15). As will be subsequently described in detail, the drive assembly 16 controls the pivoting of the arm 154 so that it cooperates with the sucker 24 to feed pamphlet portions into the takeaway cylinder 130 at the desired rate.

Figure 16:
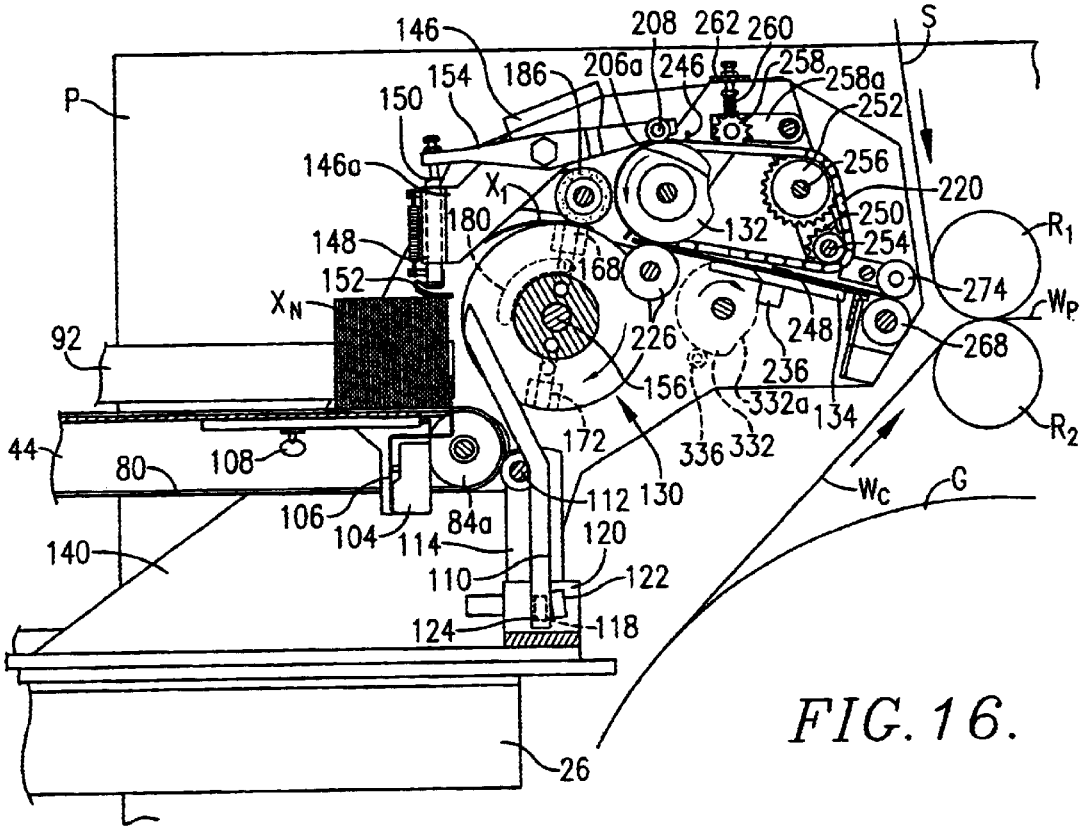
FIG. 16 is a view of the inserter similar to the views of FIGS. 14–15 with the forward-most pamphlet portion further advancing through the cycle particularly illustrating the take-away cylinder advancing the portion towards the knurled roller.
Figure 17:
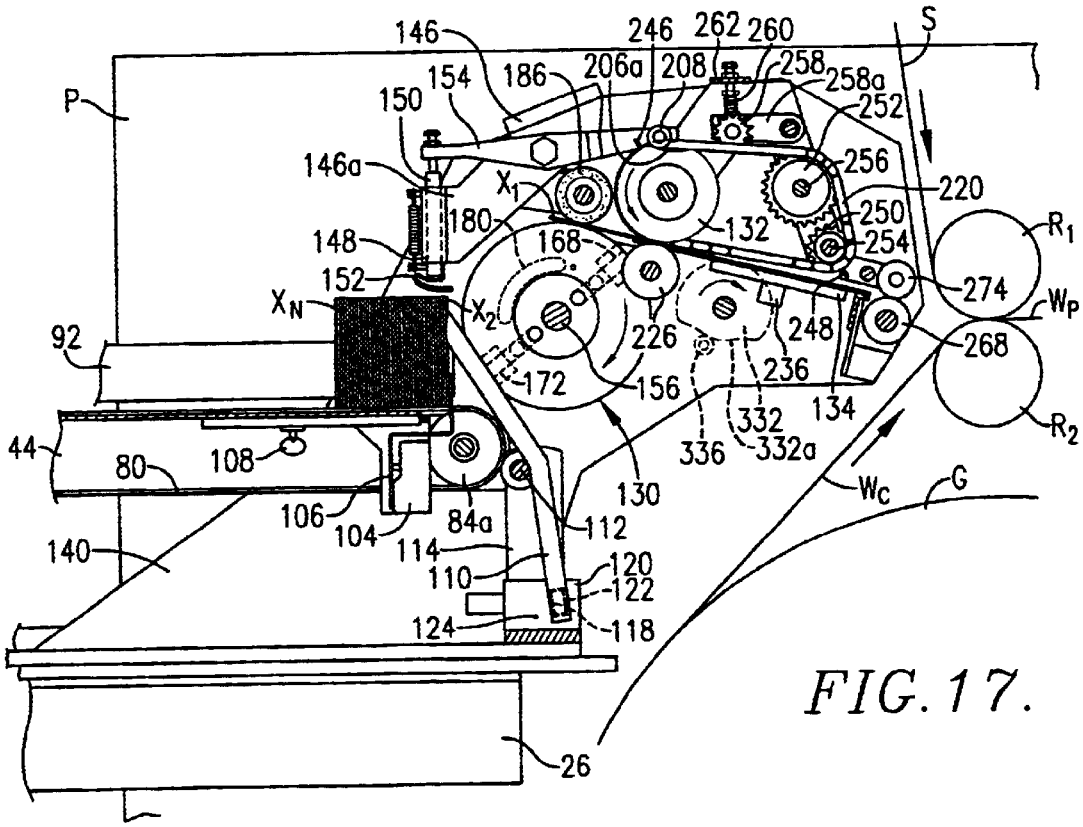
FIG. 17 is a view of the inserter similar to the views of FIGS. 14–16 with the forward-most pamphlet portion further advancing through the cycle particularly illustrating the portion entering the knurled roller of the aligner assembly.

As shown in FIGS. 15–17, the takeaway cylinder 130 receives the pamphlet portions $X_n$ from the sucker 24 of the feeder assembly 12 and introduces them into the knurled roller 132, one at a time, at the desired rate set by the drive assembly 16 (as described below). In particular, as shown in FIGS. 5–8, the cylinder 130 is rotatably supported on the housing 126 by a takeaway shaft 156. The shaft 156 is supported on the sidewalls 140,142 by a pair of bearings 158,160 (see FIG. 8). For purposes that will subsequently be described, the left and right ends of the shaft 156 extend through the respective walls 140,142. The left end has a primary driven gear 162 fixed thereto and the right end has a sprocket 164 fixed thereto. The illustrated cylinder 130 is a pneumatic takeaway cylinder. In this regard, the cylinder 130 includes four vacuum takeaway ports 166, 168, 170, and 172 (see FIG. 8) configured to temporarily adhere a pamphlet portion $X_1$ to the cylinder 130 for transference to the knurled roller 132 and then release the portion $X_1$. The ports 166,168 are positioned on the cylinder 130 diametrically opposite of the ports 170,172. In this manner, the cylinder 130 can transfer two of the pamphlet portions $X_n$ for every one revolution of the cylinder 130.

The pair of ports 166,168 and the pair of ports 170,172 are virtually identically configured, therefore, only the pair of ports 166,168 will be described in detail with the understanding that the pair of ports 170,172 are similarly constructed. The ports 166,168 each present a gasketed surface (see FIG. 6) on the circumference of the cylinder 130 (e.g., formed from rubber, cork, etc.) to facilitate gripping the pamphlet portion $X_1$. The ports 166,168 are spaced from each other by a recess 174 extending around the circumference of the cylinder 130 (see FIG. 8). The recess 174 is configured to receive the sucker rod 110 so that the upper end of the rod 110 recesses behind the circumferential surface of the ports 166,168 when the sucker 24 is in the transfer position as shown in FIG. 15. In this manner, transfer of the pamphlet portion $X_1$ from the sucker rod 110 to the cylinder 130 is facilitated. Each of the ports 166,168 is in vacuum communication with a vacuum takeaway manifold 176 by a passageway 178 (see FIG. 8). The passageway 178 is plugged at its end opposite the manifold 176 after manufacture. The manifold 176 is in vacuum communication with the vacuum source (not shown). The manifold 176 is supported on the housing sidewall 142 and is fixed relative thereto. The manifold 176 includes an arcuate shaped port 180 that extends only partially around the shaft 156 so that the passageway 178 is in vacuum communication with the port 180 only a portion of one revolution of the cylinder 130 (see FIG. 5). Positioned adjacent the port 180 is a takeaway relief aperture 182 in air communication with the atmosphere (see FIG. 5). A gasket 184 is fixed to the cylinder 130 and positioned between the cylinder 130 and the manifold 176 to facilitate sealing the communication between the port 180 and the passageway 178 (see FIG. 8).

The ports 166,168 rotate with the cylinder 130 and encounter a pickup position as shown in FIG. 15 and a release position as shown in FIG. 16. When the ports 166,168 are in the pickup position, the sucker rod 24 is in the transfer position and the passageway 178 is in a generally sealed, communicating relationship with the leading edge of the port 180. When the ports 166,168 are in the release position, they have rotated clockwise so that they are just past center on the top of the cylinder 130, and the passageway 178 has just gone out of communication with the trailing edge of the port 180 and just began communicating with the relief aperture 182. In this manner, when the ports 166,168 are in the pickup position, vacuum pressure is supplied from the port 180 through the passageway 178 through the ports 166,168 to adhere the forward-most pamphlet portion (portion $X_1$ in FIG. 15) to the cylinder 130 as shown in FIG. 15. When the ports 166,168 are in the release position, vacuum pressure through the ports 166,168 is broken by the relief aperture 182 so that the upper end of the pamphlet portion (e.g., portion $X_1$ in FIG. 16) no longer adheres to the cylinder 130 as shown in FIG. 16.

Figure 8:
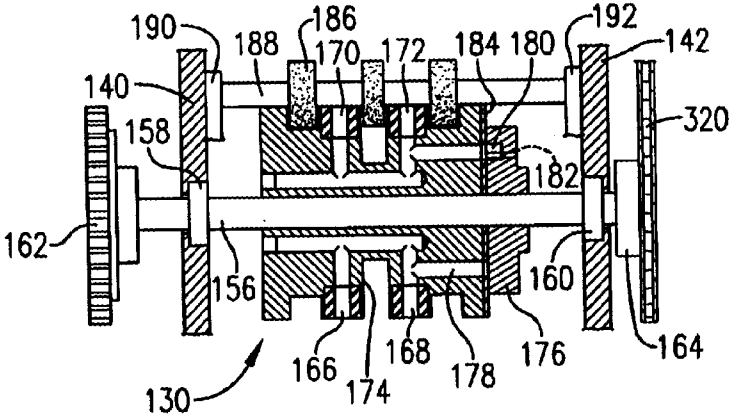
FIG. 8 is an enlarged horizontal sectional view of the take-away cylinder of the inserter illustrating the vacuum ports therein.

The cylinder 130 includes a free-wheeling rubber roller 186 located adjacent to, and above, the cylinder 130 (see FIG. 8). The rubber roller 186 is rotatably supported on a shaft 188 that is pivotally coupled, and bearinged, to the housing sidewalls 140,142 by a pair of carrier arms 190 and 192, respectively (see FIGS. 5 and 8). The rubber roller 186 is biased into contact with the cylinder 130 by a spring wire assembly 194 (see FIG. 5). In this manner, when the pamphlet portion is released by the cylinder 130, the rubber roller 186 guides the pamphlet portion in the proper tangential direction relative to the cylinder 130 (e.g., towards the knurled roller 132) without interfering with the advancement of the pamphlet portion and without allowing the pamphlet portion to spring off of the surface of the cylinder 130. When the pamphlet portion is released by the cylinder 130, as will be described in detail below, it is fed into the knurled roller 132 of the aligner pin assembly 136.

The aligner pin assembly 136 receives the preprinted pamphlet portions $X_n$ from the takeaway cylinder 130, aligns the pamphlet portions $X_n$ into the desired alignment, and feeds them into the nip roller 138 for insertion into the printing press P in substantial registration. Substantial registration, as that term is used herein, refers to the registration of the preprinted pamphlet portion relative to the complemental pamphlet portion when the two are joined in the printing press P to form the completed pamphlet. A completed pamphlet can only be formed if the preprinted pamphlet portion is fed into the press P in sufficient alignment and at a synchronized rate relative to the complemental pamphlet portion running in the press P. The complemental portion is typically the back page of the completed pamphlet. The preprinted portion is typically the remainder of the pamphlet, folded into book form, and having a folded binding-type edge extending along the height of the pamphlet on one side and a loose leaf-type edge, spaced from the binding-type edge by the width of the pamphlet. Sufficient alignment, therefore, requires the preprinted portion to be positioned right side up relative to the complemental portion (e.g., so the printing on each portion reads in the same direction) and be at least substantially oriented relative to the complemental portion (e.g., so the four corners of each portion generally align). The synchronized rate is provided by the drive assembly 16 and will be discussed below in conjunction therewith. The alignment is achieved by the aligner pin assembly 136, including the knurled roller 132 and the vacuum plate 134. It should be noted that the sufficient alignment also has a lateral component that is preset by the guide rails 92,94 prior to the pamphlet portions being introduced into the aligner assembly 14.

In more detail, as shown in FIG. 4, the knurled roller 132 includes three rollers 196, 198, and 200, each having a knurled surface and being spaced along, and fixed to, a shaft 202. The shaft 202 is rotatably supported on the housing sidewalls 140,142 (e.g., by bushings, bearings, etc.) and for purposes that will subsequently be described, one end of the shaft 202 extends through the sidewall 142 where it is coupled to a knurled roller driven sprocket 204. The middle roller 198 includes a knurled roller cam surface 206 adjacent the knurled surface that is configured to receive a cam wheel 208 that is rotatably supported on the end of the pivot arm 154. As will subsequently be described in detail, the cam surface 206 and the cam wheel 208 cooperate with the drive assembly 16 to time the holdback foot 128. The knurled roller 132 further includes four knurled roller drive sprockets 210, 212, 214, and 216 that are each entrained by one of a corresponding aligner pin chain 218, 220, 222, and 224, respectively (see FIG. 4). The knurled roller 132 additionally includes a freewheeling rubber roller 226 located adjacent to, and below, the roller 132 (see FIG. 5). Similar to the rubber roller 186 previously described, the rubber roller 226 is rotatably supported on a shaft 228 that is pivotally coupled, and bearinged, to the housing sidewalls 140,142 by a pair of carrier arms 230 and 232, respectively (see FIG. 6). The rubber roller 226 is biased into contact with the knurled roller 132 by a spring wire assembly 234 (see FIG. 5). In this manner, when the pamphlet portion is received by the knurled roller 132, the rubber roller 226 guides the pamphlet portion into contact with knurled surface of the roller 132 which in turn guides the pamphlet portion in the proper direction (e.g., towards the vacuum plate 134) without interfering with the advancement of the pamphlet portion and without allowing the pamphlet portion to come out of contact with the knurled surface of the roller 132 (see FIGS. 17 and 18).

The vacuum plate 134 at least partially restricts advancement of the pamphlet portions $X_n$ to facilitate alignment of the portions $X_n$. In particular, the plate 134 includes a top surface having a plurality of apertures therein that are in vacuum communication with a bottom port 236 (see FIG. 5). The port 236 is connected to the vacuum source (not shown). Once the pamphlet portion $X_1$ is received on the vacuum plate 134 and has cleared the knurled roller 132, the pamphlet portion $X_1$ is at least partially adhered to the surface of the plate 134 so as to at least partially retard its advancement along the plate 134 to allow the rotational speed of the chains 218,220,222,224 to overcome the pamphlet portion $X_1$ (see FIGS. 18 and 19).

Figure 9:
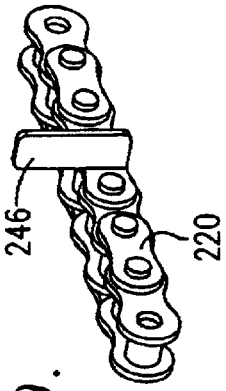
FIG. 9 is an enlarged perspective view of a portion of one of the aligner chains of the inserter illustrating an aligner pin.

Once the pamphlet portion $X_1$ is at least partially retained on the vacuum plate 134, the remaining components of the aligner pin assembly 136 cooperate to align the pamphlet portion $X_1$. Particularly, the aligner pin assembly 136 further includes four pairs of aligner pins 238, 240, 242, and 244, with each pair of pins being associated with a corresponding one of the chains 218,220,222,224, respectively (see FIG. 4). The pairs of aligner pins 238,240,242,244 are all similarly configured, accordingly, only the pair of aligner pins 240 associated with the chain 220 will be described in detail with the understanding that the pairs 238,242,244 and chains 218,222,224 are similarly constructed. The pair of aligner pins 240 includes aligner pins 246 and 248 coupled to the chain 220 and equally spaced along the chain 220 from one another (see FIG. 18). Each of the pins 246,248 project out to one side of the chain 220 and project radially beyond the path of the chain 220 (see FIG. 9). In this manner, as the chain is driven along its path, the pins 246,248 are inverted from the chain 220 relative to the pamphlet portion $X_1$ and do not interfere with the sprockets but can engage the pamphlet portion $X_1$ lying adjacent the path of the chain 220 (see FIGS. 18 and 19). As detailed below, the drive assembly 16 rotates the roller 132 in a counterclockwise direction (when viewed as in FIG. 18) so that the sprocket 212 drives the chain 220 counterclockwise. The chain 220 carries the aligner pins 246,248 in a counterclockwise direction until one of the pins 246,248 (and one of the pins of the pair 242) engages the edge of the pamphlet portion $X_1$ that is partially retained on the vacuum plate 134 (see FIGS. 18 and 19). The contacting alignerpins align the pamphletportion $X_1$ and advance it to the nip roller 138 (see FIG. 19).

Figure 18:
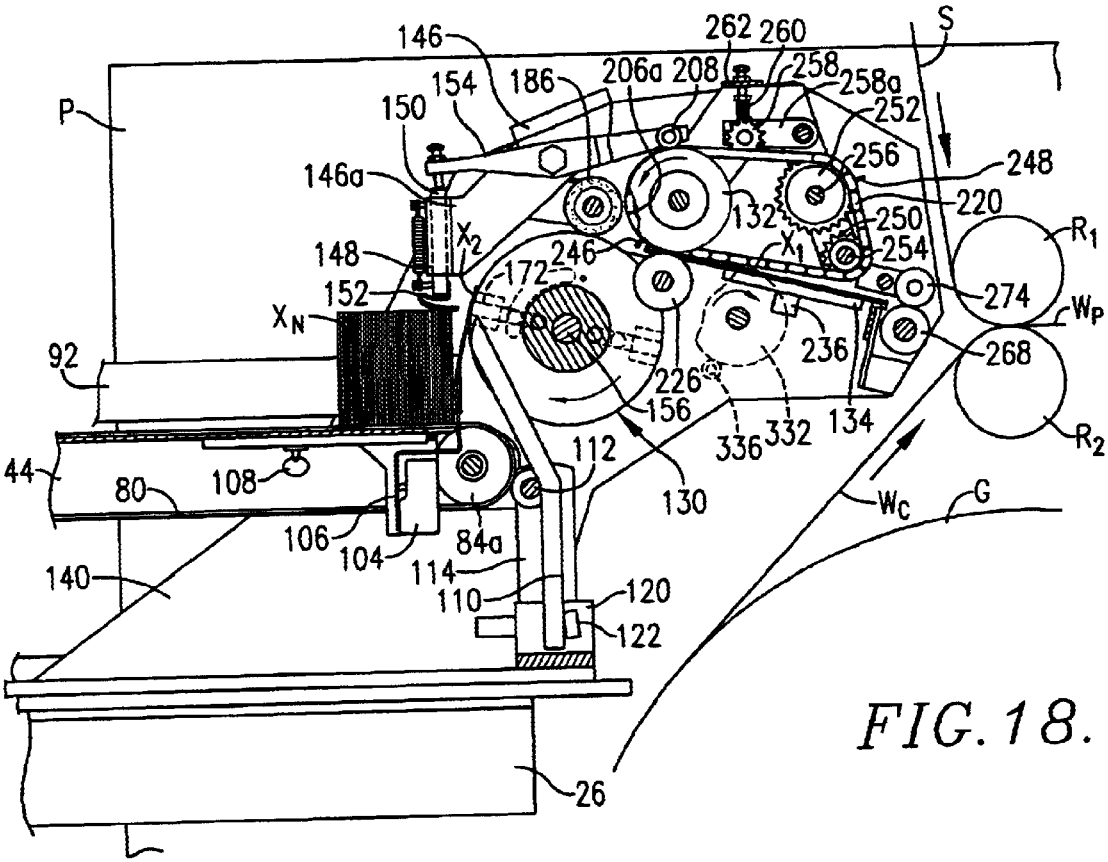
FIG. 18 is a view of the inserter similar to the views of FIGS. 14–17 with the forward-most pamphlet portion further advancing through the cycle particularly illustrating the portion engaging the vacuum plate of the aligner assembly and the sucker transferring the next pamphlet portion to the take-away cylinder.

The chain 220 extends from the sprocket 212 to entrain two other sprockets 250 and 252 that are each rotatably carried on a corresponding shaft 254 and 256, respectively (see FIG. 18). The sprockets 250,252 are configured to maintain the path of the chain 220, and thus the pins 246,248 inverted therefrom, generally adjacent to the top surface of the vacuum plate 134 so that the pins 246,248 sufficiently advance the pamphlet portion $X_1$ to the nip roller 138 (see FIG. 19). It is important that the chain 220 remains relatively taught. In this regard, an idler sprocket 258 is pivotally supported on the housing 126 above the chain 220 by a shafted arm **258*a* and is spring biased into contact with the chain 220 by the biasing mechanism 260 (see FIG. 18). The biasing mechanism 260 is supported on a crossbar 262 (shown in fragment in FIG. 4) that extends between the housing sidewalls 140,142. However, it is also important that the pins 246,248 do not advance the pamphlet portion $X_1$ too far into the nip roller 138 (e.g., "push" the pamphlet portion $X_n$ against the roller 138 and cause the portion $X_n$ to crimp or buckle, etc.). In this regard, the chain 220 is pivotally supported on the housing 126 to allow the chain 220 to pivot upward (relative to the shaft 202) to a fixed position (not shown) to allow wider pamphlet portions to clear the pins 246,248 without being crimped against the nip roller 138. Particularly the shafts 254,256 are journaled (e.g., by bearings, bushings, etc.) into a pair of carrier arms 264 and 266 that pivot about the shaft 202 (see FIGS. 4 and 5). The carrier arms 264,266 can be pivoted upward to allow the pins 246,248 to clear wider pamphlet portions. The arms 264,266 can be maintained in this position relative to the housing sidewalls 142,144 in any suitable manner (e.g., cotter-type pins, detent-type mechanisms, etc.). The crossbar 262 that extends between the housing sidewalls 140,142 is fixed to the carrier arms 264,266 so that the biasing mechanism 260 pivots with the arms 264,266**.

Other than the pivotal adjustment of the carrier arms 264,266 discussed above, the configuration of the aligner pins 246,248 need not be adjusted in order to run pamphlet portions having dimensions differing from the previously ran pamphlet portions. That is to say, the spacing of the aligner pins 246,248 is independent of the width of the pamphlet portions $X_n$. In this regard, the aligner pins 246, 248 align the pamphlet portions $X_n$ by engaging only a single edge of the portions $X_n$. The aligner pins 246,248 preferably engage the folded binding-type edge rather than the loose leaf-type edge to facilitate a more uniform alignment of all pamphlet portions $X_n$. That is to say, the loose leaf-type edge of each pamphlet may tend to vary in configuration from pamphlet to pamphlet (e.g., one of the leafs, or pages, may project further than the rest of the pages and may present a slightly angled edge relative to the folded binding-type edge).

It is within the ambit of the present invention to utilize various alternative configurations for the aligner pin assembly. However, it is important that the spacing of the pins be independent of the dimensions of the pamphlets, thereby requiring only minimal adjustment to run pamphlets of varying sizes. Additionally, the pins are preferably inverted relative to the pamphlet portions and align the portions by engaging their folded binding-type edge. Depending on the setup of the printing press being fed by the inserter, the folded edge of the pamphlets may be the leading edge (i.e., the first edge through the aligner pin assembly). For example, the aligner pin assembly could be configured to align the pamplet portions by their leading edge. One manner of accomplishing this is to position a conveyor belt below the inverted pins to carry the pamphlet portions at a faster rate than the pins are traveling thereby causing the leading edge of the pamphlet portions to engage the slower moving pins. A source of positive air pressure could be applied to the pamphlet portions to facilitate their engagement with the conveyor belt.

The aligner pin assembly 136 advances the aligned pamphlet portions $X_n$ to the nip roller 138 which inserts the portions $X_n$ into the printing press P. In more detail, as shown in FIGS. 4 and 5, the nip roller 138 includes a power roller 268 fixed to a shaft 270 that is rotatably supported on the housing sidewalls 140,142 (e.g., by bearings, bushings, etc.). For purposes that will subsequently be described, the shaft 270 extends through the sidewall 142 where it is fixed to a nip roller driven sprocket 272. The power roller 268 is preferably formed of a gripping material (e.g., rubber) to facilitate advancing the pamphlet portions $X_n$. The power roller 268 may also include structure (not shown) for supporting the pamphlet portions $X_n$ during their insertion into the printing press P (e.g., guide wires, a support plate, etc.).

Figure 3:
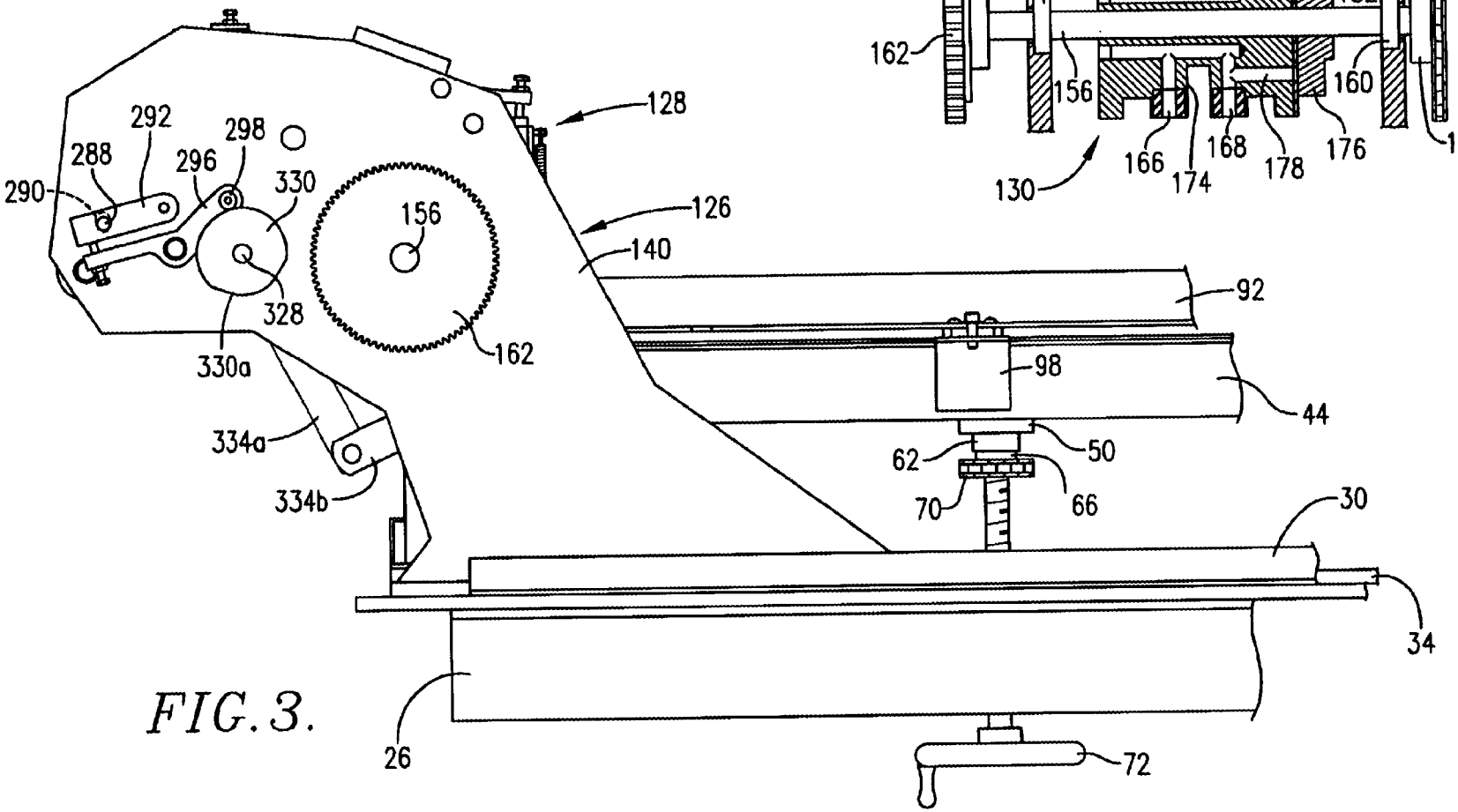
FIG. 3 is an enlarged fragmentary side elevational view of the inserter illustrating the drive side.

The nip roller 138 further includes a free-wheeling rubber roller 274 that is pivotally supported on the housing 126 above the power roller 268. Particularly, the rubber roller 274 includes a pair of rubber roller wheels 276 and 278 that are rotatably supported on stub shafts 280 and 282, respectively. The stub shafts 280,282 are fixed to corresponding carrier arms 284 and 286, respectively. The carrier arms 284,286 are fixed to a rod 288 that is received in pivot slots (with only pivot slot 290 in sidewall 140 being shown in FIG. 21) in the housing sidewalls 140,142. Each end of the rod 288 extends through the respective pivot slot in the sidewall 140,142 where it is fixed to one end of a corresponding pivot arm 292 and 294, respectively. The other end of each of the pivot arms 292, 294 is rotatably coupled to the corresponding sidewall 140,142 (see FIG. 21). As shown in FIG. 21, the pivot arm 292 is linked to a cam arm 296 that pivots up and down causing the rubber roller 274 to pivot between an insertion position as shown in FIG. 3 and a clearance position as shown in FIG. 21. As will be described in detail below, the cam arm 296 pivots about a middle pivot point and includes a wheel 298 rotatably supported on the end of the arm 296 opposite the pivot arm 292, that cooperates with components of the drive assembly 16 to time the pivoting of the rubber roller 274 between the insertion and clearance positions.

Figure 19:
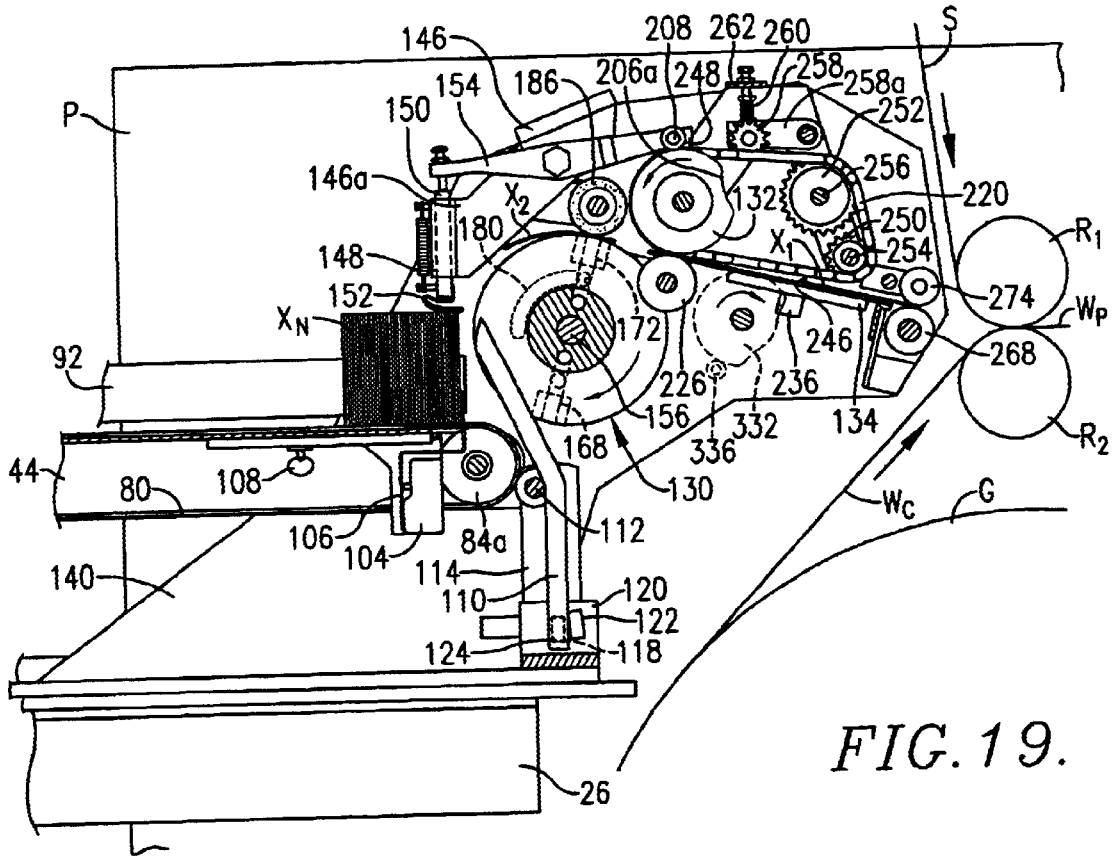
FIG. 19 is a view of the inserter similar to the views of FIGS. 14–18 with the pamphlet portions further advancing through the cycle particularly illustrating the forward-most pamphlet portion being aligned by an aligner pin and advanced into engagement with the nip roller and the next pamphlet portion being advanced toward the knurled roller.

When the rubber roller 274 is in the insertion position as shown in FIG. 3, the rubberwheels 276,278 engage the pamphlet portion $X_1$ forcing it against the power roller 268 which advances the portion $X_1$ into contact with the pinch rollers $R_1$ and $R_2$ of the printing press P (see FIGS. 19 and 20). When the rubber roller 274 is in the clearance position as shown in FIG. 21, the rubber wheels 276,278 are spaced above the pamphlet portion $X_1$ so as not to engage it thereby allowing the portion $X_1$ to ride on or slide on the power roller 268 so as not to advance further towards the press P. In this manner, the nip roller 138 does not force the pamphlet portion into the pinch rollers $R_1$ and $R_2$ of the press P causing it to crimp or buckle (e.g., if the pinch rollers $R_1$ and $R_2$ are rotating at a slower revolution rate than the rate at which the pamphlet portion $X_1$ is being advanced into the press P).

As discussed above for pamphlet portions having varying widths, the aligner assembly 14 is slidably adjustable relative to the base 18 and thus relative to the press P. In this regard the aligner assembly 14 can be slid closer to, or further from, the press P to set a desired distance between the nip roller 138 and the pinch rollers $R_1$, $R_2$ corresponding to the width of the pamphlet portions that are being inserted in the press P. As shown in FIG. 20, the aligner assembly 14 should be spaced from the pinch rollers $R_1$, $R_2$ a sufficient distance to allow the leading edge of the pamphlet portion $X_1$ to be received in the pinch rollers $R_1$, $R_2$ while the trailing edge of the pamphlet portion $X_1$ is supported on the power roller 268.

As indicated above, the drive assembly 16 mechanically synchronizes the feeder and aligner assemblies 12,14 with the printing press P to enable the formation of the completed pamphlets. The drive assembly 16 includes a geared transmission 300 that transmits power from the bull gear G of the press P to the inserter 10, a timing chain assembly 302 that synchronizes the feeder and aligner assemblies 12,14, and internal camming 304 for linking various time-related components of the inserter 10 (see FIG. 2).

The illustrated bull gear G of the press P drives an anvil role (not shown) of the press P that carries the webbing $W_c$ of complemental pamphlet portions. One or more plate cylinders (not shown) operate against the role to print the complemental pamphlet portions. The plate cylinders are driven off of the bull gear G by a print gear (not shown) that corresponds to the diameter of the plate cylinder. Plate cylinders typically have either one image or two, diametrically opposed images, on the cylinder and thus either print one or two portions per revolution, respectively. The geared transmission 300 transmits power from the bull gear G to the inserter 10 at the same rate that the print gear transmits power from the bull gear G to the corresponding print cylinder, and gears that power according to whether the print cylinder is a one or two image cylinder.

In more detail, as shown in FIGS. 10–13, the geared transmission 300 includes a lower drive gear 306 and an upper drive gear 308 linked by a drive chain 310. The lower drive gear 306 is removably and adjustably mounted on the sidewall of the press P that is adjacent the housing sidewall 140 of the inserter 10 (i.e., the sidewall distal to the press operator). Particularly, the gear 306 is rotatably supported on one end of a bracket assembly 312. The bracket assembly 312 is pivotally mounted on the distal sidewall of the press P. The lower drive gear 306 intermeshes with the bull gear G and includes a sprocket 314, fixed to the gear 306, that is entrained by the chain 310 (see FIG. 11). In a similar manner, the upper drive gear 308 is removably and pivotally mounted on the distal sidewall of the press P by a bracket assembly 316. The upper drive gear 308 intermeshes with the primary driven gear 162 that is fixed to the right end of the takeaway shaft 156 (see FIGS. 8 and 11). The chain 310 extends upward from the sprocket 314 to entrain a sprocket 318 that is fixed to the upper drive gear 308.

The size of the sprocket 314 that is fixed to the lower drive gear 306 and the size of the upper drive gear 308 do not change regardless of the size of the pamphlet being produced in the press P. However, the size of the lower drive gear 306 and the size of the sprocket 318 that is fixed to the upper drive gear 308 do change according to the size of the pamphlet being produced in the press P. Particularly, the lower drive gear 306 is configured to match the configuration (i.e., number of cogs, diameter, etc.) of the print gear that runs the print cylinder on the press P. As previously indicated the size of the print gear changes according to the size of the pamphlet being produced (e.g., the smaller the width of the pamphlet, the smaller the diameter of the print gear, and the larger the width of the pamphlet, the larger the diameter of the print gear, etc.). Accordingly, each size of pamphlet being produced on the press P has a corresponding print cylinder and print gear and each of these print gears has a matched lower drive gear 306. For relatively larger lower drive gears 306 (corresponding to relatively wider pamphlets) the inserter 10 will be slid further away from the press P, both to compensate for the larger gear 306 and to set the proper distance between the nip roller 138 and the pinch rollers $R_1$ and $R_2$ of the press P. The pivotal bracket assembly 312 provides for the necessary adjustment to allow the gear 306 to properly intermesh with the bull gear G.

Figure 12:
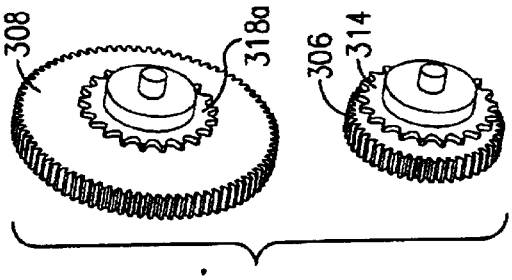
FIG. 12 is a schematic diagram of the upper and lower drive gears and their corresponding sprockets of the inserter illustrating a two-to-one drive setup for use with a two-image print cylinder on the printing press (not shown)
Figure 13:
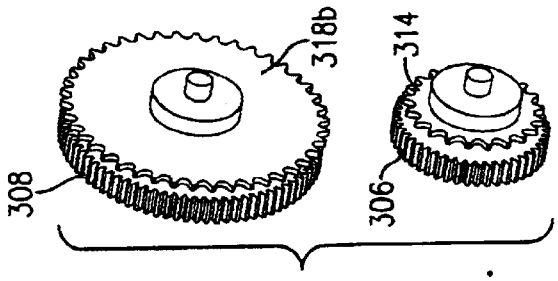
FIG. 13 is a schematic diagram of the upper and lower drive gears and their corresponding sprockets of the inserter illustrating a one-to-one drive setup for use with a one-image print cylinder on the printing press (not shown)
Figure 11:
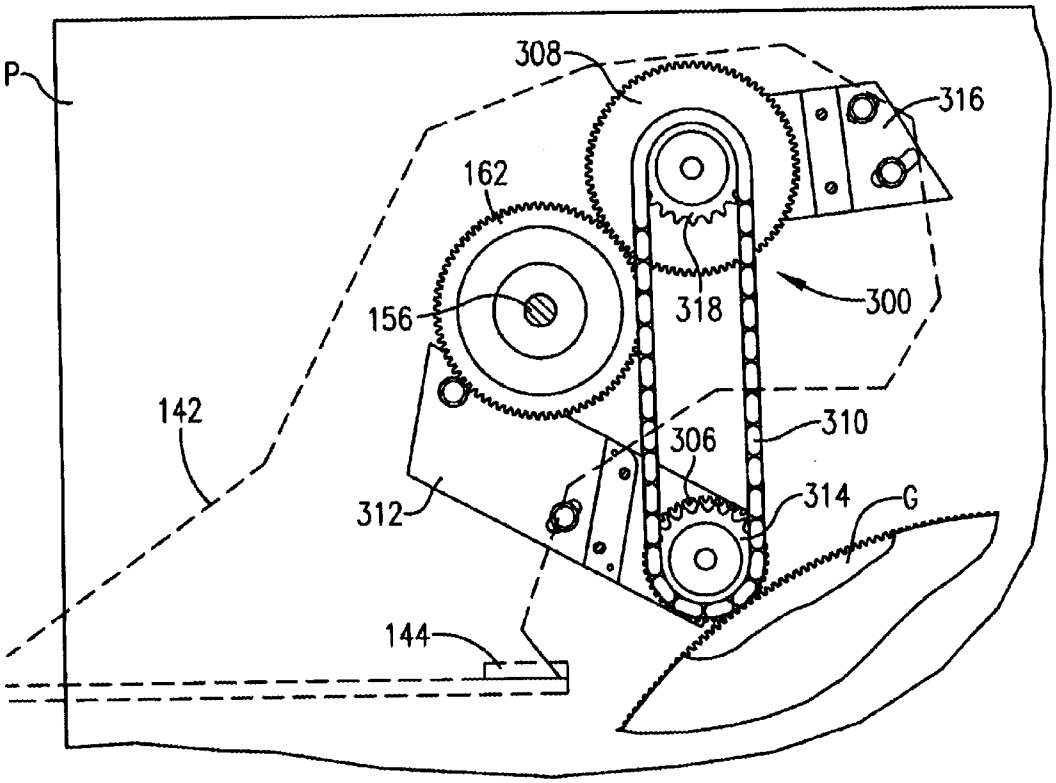
FIG. 11 is an enlarged fragmentary side elevational view of the inserter with the housing shown in phantom illustrating the transmission of the drive assembly and shown in combination with the printing press (fragmentary view)

For pamphlets having a relatively shorter width, the print cylinder will typically have two, diametrically opposite images thereon, and thus can print two pamphlets per revolution. The inserter 10 must therefore feed twice as many pamphlet portions $X_n$ per a cycle relative to a single image print cylinder. Accordingly, as shown in FIGS. 12 and 13, the sprocket 318 changes according to whether the print cylinder prints one or two images per revolution. FIG. 12 illustrates a two image drive setup with the upper drive gear 308 having a two-to-one sprocket 318*a* fixed thereto. That is to say, the sprocket 318*a* corresponds to a two image print cylinder and thus drives the upper gear 308 twice as fast as a one image cycle. FIG. 13 illustrates a one image drive setup with the upper drive gear 308 having a one-to-one sprocket 318*b* fixed thereto. That is to say, the sprocket 318*b* corresponds to a one image print cylinder and thus drives the upper gear 308 half as fast as the two image setup illustrated in FIG. 12. For a one image drive setup, the chain 310 will be relatively longer (e.g., have more links therein) than in a two image drive setup. The pivotal bracket assembly 316 provides for any necessary adjustment to allow the gear 308 to properly intermesh with the primary driven gear 162.

As just described, the transmission 300 transmits synchronized power from the press P to the primary driven gear 162 of the inserter 10. The timing chain assembly 302 distributes the synchronized power to the feeder and aligner assemblies 12,14 and synchronizes the assemblies 12,14, one with the other, to enable the inserter 10 to insert the preprinted pamphlet portions $X_n$ into the printing press P in such a manner that enables the completed pamphlets to be formed. That is to say, not only do the pamphlet portions $X_n$ have to be fed into the press P in the proper alignment (as discussed above in connection with the aligner assembly 14), but also in the proper, synchronized timing to allow the pamphlet portions $X_n$ to mate in substantial registration with the complemental pamphlet portions on the web $W_c$ to form the completed pamphlets on the web $W_p$.

In more detail, as shown in FIGS. 1, 4, and 8, the timing chain assembly 302 includes a timing chain 320 that entrains the sprocket 164 (that is fixed to the right end of the takeaway shaft 156) to receive the synchronized power therefrom. That is to say, the upper drive gear 308 of the transmission 300 drives the primary driven gear 162, that in turn drives the takeaway shaft 156 (and the takeaway cylinder 130), that in turn drives the sprocket 164 that drives the timing chain 320. The gear 162 and the sprocket 164 are in a one-to-one relationship. The sprocket 164 drives the chain 320 in a clockwise direction when viewed as illustrated in FIG. 1. The timing chain 320 in turn drives the knurled roller driven sprocket 204 (that drives the aligner pin assembly 136), an internal camming driven sprocket 322 (as will be subsequently described in detail), and the nip roller driven sprocket 272 (that drives the power roller 268 of the nip roller 138). The timing chain 320 further entrains a pair of takeup idler sprockets 324 and 326.

The timing chain 320 engages the bottom of the knurled roller driven sprocket 204 to drive the sprocket 204 in a counterclockwise direction when viewed as illustrated in FIG. 1 so that the sprocket 204 drives the aligner pin assembly 136 (including the knurled roller 132) in a counterclockwise direction. The sprocket 204, and the corresponding aligner pin chain drive sprockets 210,212,214,216, are configured so that the aligner pin assembly 136 delivers two pamphlet portions $X_n$ to the nip roller 138 for every one revolution of the takeaway cylinder 130.

The timing chain 320 entrains the nip roller driven sprocket 272 to drive the sprocket 272 in a clockwise direction when viewed as illustrated in FIG. 1 so that the sprocket 272 drives the power roller 268 of the nip roller 138 in a clockwise direction. The sprocket 272, and the corresponding power roller 268, are configured so that the nip roller 138 inserts two pamphlet portions $X_n$ into the press P for every one revolution of the takeaway cylinder 130.

In correspondence with the synchronized cycle timing provided by the timing chain assembly 302 detailed above, the internal camming 304 times the sucker 24, the holdback foot 128, and the rubber roller 274 of the nip roller 138 to complement the synchronized cycle timing. In more detail, the cam sprocket 322 is fixed to the right end of a cam shaft 328. The cam shaft 328 extends through each of the sidewalls 140,142 and is rotatably supported therein (e.g., by bushings, bearings, etc.). For purposes that will subsequently be described, fixed to the left end of the cam shaft 328 is a nip roller cam 330. Fixed to the cam shaft 328 between the walls 140,142 is a sucker cam 332.

The sucker cam 332 is a wheel having a nonuniform diameter so that a portion of the wheel has a cam surface 332*a* that is radially closer to the cam shaft 328 relative to the rest of the circumference of the sucker cam 332 (see FIG. 5). Positioned directly adjacent the cam 332 is a sucker cam arm 334 (see FIGS. 5 and 6). The cam arm 334 includes an upper arm portion 334*a* that is pivotally coupled to a lower arm portion 334*b*. The arm portion 334*a* is slidably received on the cam shaft 328 and includes an arm wheel 336 rotatably supported on the arm portion 334*a*. The arm wheel 336 engages the circumferential surface of the sucker cam 332. The arm portion 334*b* is fixed to the sucker shaft 112. The cam arm 334 is spring biased (not shown) against the cam shaft 328 so that the arm wheel 336 remains in constant engagement with the sucker cam 332.

When the arm wheel 336 is in engagement with the cam surface 332*a*, the cam arm 334 is slid upward against the cam shaft 328 thereby slightly rotating the sucker shaft 112 corresponding with the sucker rod 110 being in the engagement position as shown in FIG. 14. As the sucker cam 332 rotates, the arm wheel 336 goes out of engagement with the cam surface 332*a* causing the cam arm 334 to slide downward. As the arm 334 slides downward, it rotates the sucker shaft 112 back corresponding with the sucker rod 110 being in the transfer position as shown in FIG. 15. The timing chain 320 engages the top of the cam sprocket 322 to drive it in clockwise direction which in turn rotates the sucker cam 332 in a clockwise direction when viewed as illustrated in FIG. 14. The cam sprocket 322 and the sucker cam 332 are configured to pivot the sucker rod 110 between the engagement and transfer positions twice for every one revolution of the takeaway cylinder 130 so that the sucker rod 110 is in the transfer position every time one of the pair of takeaway ports 166,168 and 170,172 are in the pickup position as illustrated in FIG. 15.

The camming 304 includes the previously introduced holdback cam surface 206 on the middle roller 198 of the knurled roller 132 and the holdback cam wheel 208 mounted on the front end of the pivot arm 154 of the holdback foot 128. The cam surface 206 and the cam wheel 208 control the movement of the holdback foot 128 between the clearance and holdback positions. The cam surface 206 is a circumferential surface that rotates with the middle roller 198 in a counterclockwise direction when viewed as illustrated in FIG. 14. The cam surface includes a recessed portion 206*a*. The cam wheel 208 engages the cam surface 206 as it rotates. When the cam wheel 208 engages the recessed portion 206*a*, the pivot arm 154 pivots upward corresponding with the holdback foot 128 being in the clearance position as shown in FIG. 14. As the cam surface 206 continues to rotate, the cam wheel 208 comes out of engagement with the recessed portion 206*a* causing the pivot arm 154 to pivot downward, corresponding with the holdback foot 128 being in the holdback position as shown in FIG. 15. The cam surface 206 is configured so that the holdback foot 128 pivots from the clearance position into the holdback position after the sucker rod 110 is in the engagement position but before the sucker rod 110 pivots to the transfer position, and the holdback foot 128 pivots back into the clearance position before the sucker rod 110 pivots back into the engagement position.

As previously indicated, the internal camming driven sprocket 322 drives the nip roller cam 330. The nip roller cam 330 controls the pivoting of the rubber roller 274 of the nip roller 138 between the insertion and clearance positions. In particular, the wheel 298 supported on the end of the cam arm 296 engages the circumferential surface of the nip roller cam 330 as the cam 330 is rotated in a counterclockwise direction when viewed as illustrated in FIG. 21. The circumferential surface of the cam 330 includes a radially recessed portion 330*a*. When the wheel 298 engages the radial recess 330*a*, the cam arm 296 pivots upward causing the pivot arm 292 to pivot upward corresponding with the rubber roller 274 being in the clearance position as shown in FIG. 21. As the nip roller cam 330 continues to rotate, the wheel 298 comes out of engagement with the radial recess 330*a*. When the wheel 298 is out of engagement with the radial recess 330*a*, the cam arm 296 (and pivot arm 292) pivot downward corresponding with the roller 274 being in the insertion position as shown in FIG. 3. The nip roller cam 330 is configured so that the roller 274 pivots from the insertion position to the clearance position once the pamphlet portion $X_n$ contacts the pinch rollers $R_1$ and $R_2$ of the press P and the roller 274 pivots back into the insertion position once the pamphlet portion $X_n$ has been inserted into the press P.

OPERATION

In operation, as shown in FIGS. 14–21, the inserter 10 feeds the pamphlet portions $X_n$, sequentially and one at a time, into the press P in the proper alignment and at the proper, synchronized time, to allow each pamphlet portion $X_n$ to mate in substantial registration with a complemental pamphlet portion on the web $W_c$ to form a completed pamphlet on the web $W_p$. The motor 102 drives the belts 80,82 to advance the pamphlet portions $X_n$ along the horizontal support surface 42 until the forward-most sequential pamphlet portion $X_1$ is fully engaged by the arcuate surface of the sucker rod 110 in the engagement position as shown in FIG. 14. The forward-most pamphlet $X_1$ engages the trigger element 106 of the switch 104 thereby causing the motor 102 to switch to zero output temporarily pausing the pamphlet portions $X_n$ from advancing along the surface 42. The holdback foot 128 pivots into the holdback position and then the sucker rod 110 pivots to the transfer position as shown in FIG. 15. At the same time, the takeaway ports 166,168 are in the pickup position and thus adhere the pamphlet portion $X_1$ to the takeaway cylinder 130.

The takeaway cylinder 130 rotates until it encounters the release position as shown in FIG. 16 where the pamphlet portion $X_1$ engages the rubber roller 186. The takeaway cylinder 130 continues to rotate against the rubber roller 186 thereby advancing the pamphlet portion $X_1$ into contact with the knurled roller 132 and the rubber roller 226 as shown in FIG. 17. At this stage in the cycle, the holdback foot 128 pivots back into the clearance position and the sucker rod 110 pivots back into the engagement position to engage the pamphlet portion $X_2$ as shown in FIG. 17. The knurled roller 132 continues to rotate against the rubber roller 226 to advance the pamphlet portion $X_1$ onto the vacuum plate 134 where it is temporarily retained as shown in FIG. 18. At this stage in the cycle, the holdback foot 128 has pivoted into the holdback position and the sucker rod 110 then pivots into the transfer position. Simultaneously, the ports 170,172 of the takeaway cylinder 130 have rotated into the pickup position and thus the pamphlet portion $X_2$ is adhered to the takeaway cylinder 130 as shown in FIG. 18.

The knurled roller 132 (and thus the drive sprockets 210,212,214,216) continues to rotate driving the aligner pin 246 (and one of the aligner pins from each of the other pairs 238,242,244) into contact with the trailing edge of the pamphlet portion $X_1$. The aligner pins align the pamphlet portion $X_1$ while they advance it along the vacuum plate 134 into engagement with the nip roller 138 as shown in FIG. 19. At this stage in the cycle, the takeaway cylinder 130 has rotated the ports 170,172 into the release position and the pamphlet portion $X_2$ has engaged the rubber roller 186 as shown in FIG. 19.

When the leading edge of the pamphlet portion $X_1$ engages the nip roller 138, the rubber roller 274 is in the insertion position as shown in FIG. 19 and thus the power roller 268 advances the pamphlet portion $X_1$ into contact with the press P. Specifically, the leading edge of the pamphlet portion $X_1$ is inserted into the press P at the pinch rollers $R_1$ and $R_2$ between the sheet S of adhesive material and the web $W_c$ carrying the complemental pamphlet portions. The rubber roller 274 then pivots into the clearance position as shown in FIG. 20. At this final stage of the cycle, the pamphlet portion $X_2$ is engaging the knurled roller 132 and the sucker rod 110 has pivoted back into the engagement position with the pamphlet portion $X_3$ as the ports 166,168 of the takeaway cylinder 130 approach the pickup position to begin a new cycle. The pamphlet portion $X_1$ is received in the press P where it is passes through the pinch rollers $R_1$ and $R_2$ to be joined in substantial registration with a complemental pamphlet portion to form the completed pamphlet adhered to the web $W_p$.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. An inserter for synchronously feeding a preprinted portion of a pamphlet into a printing press to be adhered to a complemental portion of the pamphlet in substantial registration to form the completed pamphlet, the printing press including a print cylinder that prints the complemental portion of the pamphlet, the preprinted portion of the pamphlet including a leading edge and a trailing edge, the inserter comprising:

a feeder assembly;

an aligner assembly; and a drive assembly operable to synchronize said feeder assembly and said aligner assembly with the printing press to enable the formation of the completed pamphlets, said feeder assembly being operable to feed the preprinted portion of the pamphlet into the aligner assembly, said aligner assembly being operable to introduce the preprinted portions of the pamphlets into the printing press in sufficient alignment to allow the formation of the completed pamphlets, said aligner assembly including a pneumatic take-away cylinder and a pair of spaced aligner pins, said take-away cylinder being operable to transfer the preprinted portion of the pamphlet from the feeder assembly to at least one of the aligner pins, each of said aligner pins being operable to position the preprinted portion of the pamphlet into the sufficient alignment, said spacing between the aligner pins being independent of the dimensions of the preprinted portion of the pamphlet.

2. The inserter as claimed in claim 1, said aligner assembly further including an endless element, said pair of aligner pins being fixed relative to, and spaced along, the endless element.

3. The inserter as claimed in claim 2, said aligner assembly further including an additional endless element and an additional pair of aligner pins, said additional pair of aligner pins being fixed relative to, and spaced along, the additional endless element.

4. The inserter as claimed in claim 3, said first-mentioned pair and said additional pair of aligner pins each being spaced a substantially equal distance.

5. The inserter as claimed in claim 1, said aligner assembly further including a vacuum plate operable to retain the preprinted pamphlet portion thereon when the preprinted pamphlet portion engages the vacuum plate.

6. The inserter as claimed in claim 5, said aligner assembly further including an endless element, said pair of aligner pins being fixed relative to, and spaced along, the endless element, said endless element being rotatable relative to the vacuum plate so that one of the aligner pins is drawn into contact with the trailing edge of the preprinted pamphlet portion when the preprinted pamphlet portion is retained on the vacuum plate.

7. An inserter for synchronously feeding a preprinted portion of a pamphlet into a printing press to be adhered to a complemental portion of the pamphlet in substantial registration to form the completed pamphlet, the printing press including a bull gear linked to a print cylinder by a print gear that drives the print cylinder at a print rate to print the complemental portion of the pamphlet, the inserter comprising:

a feeder assembly;

an aligner assembly operable to introduce the preprinted portions of the pamphlets into the printing press in sufficient alignment to allow the formation of the completed pamphlets; and a drive assembly operable to only mechanically synchronize said feeder assembly and said aligner assembly with the printing press to enable the formation of the completed pamphlets, said feeder assembly being operable to feed the preprinted portion of the pamphlet into the aligner assembly, said aligner assembly including a pneumatic take-away cylinder and a pair of spaced aligner pins, said take-away cylinder being operable to transfer the preprinted portion of the pamphlet from the feeder assembly to at least one of the aligner pins, each of said aligner pins being operable to position the preprinted portion of the pamphlet into the sufficient alignment, said drive assembly including a drive gear operable to be in mechanical communication with the bull gear so that when they are in mechanical communication the drive gear is synchronized with the print rate, said drive assembly further including a timing chain mechanically linking the drive gear with the take-away cylinder and the aligner pins so that when the drive gear is in mechanical communication with the bull gear the take-away cylinder and the aligner pins are synchronized with the print rate.

8. The inserter as claimed in claim 7, said drive assembly further including an additional drive gear mechanically linked to the first-mentioned drive gear and the timing chain, said first-mentioned and additional drive gears cooperating with the timing chain so that the aligner assembly introduces one preprinted pamphlet portion into the printing press for every one revolution of the additional drive gear when the first-mentioned drive gear is in mechanical communication with the bull gear.

9. The inserter as claimed in claim 7, said drive assembly further including an additional drive gear mechanically linked to the first-mentioned drive gear and the timing chain, said first-mentioned and additional drive gears cooperating with the timing chain so that the aligner assembly introduces two preprinted pamphlet portions into the printing press for every one revolution of the additional drive gear when the first-mentioned drive gear is in mechanical communication with the bull gear.

10. An inserter for synchronously feeding a preprinted portion of a pamphlet into a printing press to be adhered to a complemental portion of the pamphlet in substantial registration to form the completed pamphlet, the printing press including a bull gear that drives a print cylinder at a print rate to print the complemental portion of the pamphlet, the inserter comprising:

a feeder assembly;

an aligner assembly; and a drive assembly, said feeder assembly being operable to feed the preprinted portion of the pamphlet into the aligner assembly and including a power source and a substantially horizontal support surface, said power source being operable to move a plurality of the preprinted portions of the pamphlets along the support surface in a substantially horizontal direction into contact with the aligner assembly, said aligner assembly being operable to introduce the preprinted portions of the pamphlets into the printing press in sufficient alignment to allow the formation of the completed pamphlets, said aligner assembly including a pneumatic take-away cylinder and a pair of spaced aligner pins, said take-away cylinder being operable to transfer the preprinted portion of the pamphlet from the feeder assembly to at least one of the aligner pins, each of said aligner pins being operable to position the preprinted portion of the pamphlet into the sufficient alignment, said spacing between the aligner pins being independent of the dimensions of the preprinted portion of the pamphlet, said drive assembly being operable to only mechanically synchronize said feeder assembly and said aligner assembly with the printing press to enable the formation of the completed pamphlets, said drive assembly including a drive gear operable to be in mechanical communication with the bull gear so that when they are in mechanical communication the drive gear is synchronized with the print rate, said drive assembly further including a timing chain mechanically linking the drive gear with the take-away cylinder and the aligner pins so that when the drive gear is in mechanical communication with the bull gear the take-away cylinder and the aligner pins are synchronized with the print rate.

11. The inserter as claimed in claim 10, said feeder assembly further including a pivotal element that pivots relative to the horizontal support surface, said pivotal element being operable to transfer the preprinted pamphlet portion from the horizontal support surface to the aligner assembly.

12. The inserter as claimed in claim 11, said pivotal element being pivotal between an engagement position wherein the element extends at least partially over the horizontal support surface and a transfer position wherein the element is spaced from the horizontal support surface, said pivotal element being operable to engage the preprinted pamphlet portion when the preprinted pamphlet portion is moving along the horizontal support surface when the pivotal element is in the engagement position, said pivotal element being operable to disengage from the preprinted pamphlet portion when the preprinted pamphlet portion is transferred to the aligner assembly when the pivotal element is in the transfer position.

13. The inserter as claimed in claim 12, said feeder assembly further including a vacuum manifold in vacuum communication with the pivotal element and being operable to supply vacuum pressure to the preprinted pamphlet portion through the element when the element is in the engagement position and to relieve the vacuum pressure through the element when the element is in the transfer position.

14. The inserter as claimed in claim 10, said power source including a motor operable to selectively move the plurality of preprinted pamphlet portions along the horizontal support surface.

15. The inserter as claimed in claim 14, said power source further including a control switch operable to select when the motor moves the plurality of preprinted pamphlet portions along the horizontal support surface.

16. The inserter as claimed in claim 15, said control switch including a trigger member that projects at least partially over the horizontal support surface, said switch causing the motor to pause movement of the plurality of preprinted pamphlet portions along the horizontal support surface when one of the preprinted pamphlet portions contacts the trigger member.

* * * * *